US005684884A

United States Patent [19]

Nakaya et al.

[11] Patent Number: 5,684,884

[45] Date of Patent: Nov. 4, 1997

[54] PIEZOELECTRIC LOUDSPEAKER AND A METHOD FOR MANUFACTURING THE SAME

[75] Inventors: Chitose Nakaya; Shigeru Jomura, both of Tokyo; Juro Endo, Kumagaya, all of Japan

[73] Assignee: Hitachi Metals, Ltd., Tokyo, Japan

[21] Appl. No.: 456,101

[22] Filed: May 30, 1995

[30] Foreign Application Priority Data

May 31, 1994 [JP] Japan ..... 6-140953
May 31, 1994 [JP] Japan ..... 6-140954

[51] Int. Cl.[6] ..... H04R 25/00

[52] U.S. Cl. ..... 381/190; 381/173; 381/191; 310/322; 310/324

[58] Field of Search ..... 310/111, 158, 310/190, 317, 321, 322, 358, 800, 324; 381/173, 190, 191

[56] References Cited

U.S. PATENT DOCUMENTS

| | | | |
|---|---|---|---|
| 3,982,143 | 9/1976 | Tamura et al. | 310/322 |
| 4,045,695 | 8/1977 | Itagaki et al. | 310/322 |
| 4,401,857 | 8/1983 | Morikawa | 381/190 |
| 4,449,019 | 5/1984 | Kakehi et al. | 381/190 |
| 4,628,223 | 12/1986 | Takeuch et al. | 310/358 |
| 4,638,206 | 1/1987 | Tsunooka et al. | 310/325 |
| 4,683,396 | 7/1987 | Takeuchi et al. | 310/358 |
| 4,692,942 | 9/1987 | Morgand | 381/188 |
| 4,752,639 | 6/1988 | Haller et al. | 525/66 |
| 4,801,835 | 1/1989 | Nakaya et al. | 310/358 |
| 4,869,768 | 9/1989 | Zola | 310/358 |
| 5,030,874 | 7/1991 | Saito et al. | 310/358 |
| 5,031,222 | 7/1991 | Takaya | 381/190 |
| 5,091,471 | 2/1992 | Graves et al. | 525/98 |
| 5,196,755 | 3/1993 | Shields | 381/190 |
| 5,245,481 | 9/1993 | Kaneko et al. | 359/896 |
| 5,245,734 | 9/1993 | Issartel | 310/358 |
| 5,278,471 | 1/1994 | Uehara et al. | 310/358 |
| 5,470,912 | 11/1995 | Loar | 525/58 |

FOREIGN PATENT DOCUMENTS

| | | |
|---|---|---|
| 61-205099 | 9/1986 | Japan . |
| 62-247700 | 10/1987 | Japan . |
| 63-4799 | 1/1988 | Japan . |

*Primary Examiner*—Curtis Kuntz
*Assistant Examiner*—Rexford N. Barnie
*Attorney, Agent, or Firm*—Finnegan, Henderson, Farabow, Garrett & Dunner

[57] ABSTRACT

Disclosed is a piezoelectric loudspeaker.

According to the present invention, a piezoelectric loudspeaker comprises: a flat compound piezoelectric sheet in which multiple piezoelectric devices are arranged in an organic material; electrodes which are provided on respective surfaces of the compound piezoelectric sheet; an acoustic impedance matching support layer for maintaining the flat compound piezoelectric sheet in a curved shape and for matching an acoustic impedance; and a support frame for supporting the compound piezoelectric sheet at its circumference. Thus, sound reproduction with a desirable frequency properties that have little distortion can be performed.

27 Claims, 13 Drawing Sheets

PIEZOELECTRIC LOUDSPEAKER AND A METHOD FOR MANUFACTURING THE SAME

BACKGROUND OF THE INVENTION

1. Field of the Invention

The present invention relates to a loudspeaker that employs a piezoelectric device, and in particular to a piezoelectric loudspeaker that employs a compound piezoelectric assembly and to a method for manufacturing such a loudspeaker.

2. Description of Related Art

Generally, a loudspeaker is so designed that when a tone signal is transmitted to a voice coil that is connected to a voice cone, the interaction that occurs between the magnetic field that is generated by the voice coil and the magnetic field of a permanent magnet mechanically vibrates the voice cone, and the vibration is transferred to the atmosphere to reproduce sounds.

Ideally, sounds would be reproduced efficiently and with no discernable distortion over a wide range of from several tens of Hz to several tens of KHz, which constitutes the audible frequency range of human beings. In actuality, since it is not possible for a single loudspeaker to cover such a wide frequency range, a plurality of loudspeakers are employed that correspond to discrete frequency bands. In addition, the sizes of electromagnetic loudspeakers that use permanent magnets are increased to increase sound pressure, and their weight is accordingly greater.

Currently, there has been an increased demand for acoustic devices, such as stereo sets and televisions, that are light, thin, and compact, and pursuant to this need, piezoelectric loudspeakers that are extremely thin and light have been developed. For such a piezoelectric loudspeaker, electrodes are formed on both surfaces of a thin plate of, for example, a lead titanate zirconate (PZT) ceramic, and the resultant structure is fixed to a metal vibration plate with an adhesive. Then, when a tone signal is received, the piezoelectric effect causes the vibration plate to vibrate and sounds are reproduced.

However, a conventional piezoelectric loudspeaker that is constituted by a metal vibration plate and a single piezoelectric ceramic component has a low degree of flexibility freedom, and is acoustically hard. Further, harmonics tend to occur and, accordingly, distortion frequently occurs.

To resolve such a shortcoming, in, for example, Japanese Patent Laid-Open Nos. Sho 61-205099, Sho 62-24770, and Sho 63-4799 is disclosed a loudspeaker that employs a compound piezoelectric sheet wherein a piezoelectric ceramic and an organic material, such as a resin, co-exist to acquire both the piezoelectric effect of the piezoelectric ceramic and the flexibility of the organic material. Various types of this loudspeaker have been developed.

In the design of a loudspeaker that employs a compound piezoelectric sheet, to form the sheet multiple piezoelectric devices are mounted within a grid that is composed of an organic material, such as an epoxy resin, and electrodes are thereafter formed on both surfaces of the sheet. The completed structure is shaped like a flat sheet or a dome. A thin film for the adjustment of tones is formed on one face of each electrode to improve the tone quality.

The reproductive frequency properties of a piezoelectric loudspeaker delicately vary, depending on the material of which it is constructed and the thickness and the shape of the included components. Its output characteristics are also greatly affected by the above elements. Therefore, even though a number of improvements such as those that are described above have been made, such as the employment of a compound piezoelectric sheet and the application of a thin film to provide for the adjustment of tones, the actual reproduction characteristics of a piezoelectric loudspeaker, such as the distortion characteristics in a high tone range or the sound pressure characteristics in a middle tone range, are not yet satisfactory, and further improvement is required to contend with common electromagnetic loudspeakers.

SUMMARY OF THE INVENTION

The present invention is proposed to overcome the above described shortcomings. It is one object of the present invention to provide a piezoelectric loudspeaker whose frequency properties, etc., are superior and a method for manufacturing such a piezoelectric loudspeaker.

It is another object of the present invention to provide a piezoelectric loudspeaker by which sounds can be reproduced that have preferable frequency properties and that have less distortion, and a method for manufacturing such a piezoelectric loudspeaker.

As the result of careful study, the present invention is provided in accordance with the opinion of the present inventor that the frequency properties and the output characteristics for reproduction are greatly affected mainly by the volume rate of a piezoelectric device in a compound piezoelectric sheet, an organic material in the compound piezoelectric sheet, a curvature radius for the compound piezoelectric sheet when a loudspeaker is to be formed, and material for an acoustic impedance matching layer that improves tone quality, and that the frequency properties, etc., can be substantially improved by selecting the optimal ones.

In addition, the present invention is provided in accordance with the opinion that sound pressure characteristics, etc., can be substantially increased by especially selecting an optimal curvature for the compound piezoelectric sheet.

To overcome the above described shortcomings, according to the present invention, a piezoelectric loudspeaker comprises: a compound piezoelectric sheet in which multiple piezoelectric devices are arranged within an organic material; electrodes that are formed on both surfaces of the compound piezoelectric sheet; an acoustic impedance matching support layer, which extends to cover the electrodes, for holding the compound piezoelectric sheet in a curved shape and for matching an acoustic impedance; and a support frame for supporting the compound piezoelectric sheet around its circumference.

With the above described structure, according to the present invention, flatness of sound pressure in a comparatively high frequency range and the frequency property can be improved and the occurrence of distortion can be also limited.

A comparatively soft resin, such as polyurethane resin, a silicone rubber resin, or a silicone varnish, whose hardness value falls within the A60 to A94 range according to the Japanese Industrial Standards, for example, is employed as the acoustic impedance matching support layer to improve intonation. In addition, a comparatively hard resin, such as an epoxy resin, is employed as the organic material in the compound piezoelectric sheet, so that the compound piezoelectric sheet can itself function to retain the its curved shape. As a result, the thickness of the matching support layer is reduced, and accordingly, the degree to which the output (sound pressure) is decreased is less.

It has been determined that when a comparatively hard resin, such as an epoxy resin, is employed as the organic material in the compound piezoelectric sheet, the thickness of the matching support layer should be 0.1 mm or greater, a thickness that is sufficient to maintain the curved shape of the compound piezoelectric sheet and to inhibit the occurrence of harmonics when the sheet is vibrating. It has been further determined that when a comparatively soft resin, such as a polyurethane resin, is used as the organic material, the thickness of the matching support layer should be 0.5 mm or greater. In this fashion, the occurrence of distortion during reproduction can be substantially limited and preferable frequency properties can be acquired.

The volume ratio for the piezoelectric device in the compound piezoelectric sheet is set at 30% or higher. When the volume ratio is too low, the output characteristics will be deteriorated and the sound pressure characteristics will not be flat. When the volume ratio is too high, the output characteristics are increased, while distortion frequently occurs. Therefore, the volume ratio for the piezoelectric device is set preferably so that it falls within a range of from 40% to 80%.

In addition, according to the present invention, to resolve the previously mentioned shortcomings a piezoelectric loudspeaker comprises: a compound piezoelectric sheet that is composed of multiple piezoelectric devices that are arranged within an organic material; electrodes formed on both surfaces of the compound piezoelectric sheet; an acoustic impedance matching support layer, which extends to cover the electrodes, for holding the compound piezoelectric sheet in a curved shape and for matching an acoustic impedance; and a support frame for supporting at its circumference the compound piezoelectric sheet, the curved shape of which has a curvature radius 30 times as long as a string length of an opening.

With the above described structure, the flatness of sound pressure and the frequency properties in a comparatively high range can be improved and the occurrence of distortion can be substantially reduced.

These characteristics and properties can be improved by increasing the dimensions for the curved shape of the compound piezoelectric sheet so that they are greater than those for a predetermined size. Because when the size of the sheet is increased, so too is the volume of the piezoelectric devices that are included within the sheet, and the electromechanical conversion efficiency is improved. The effects due to the curved vibration face are also increased.

DETAILED DESCRIPTION OF THE PREFERRED EMBODIMENT

One embodiment of a piezoelectric loudspeaker according to the present invention and a method for manufacturing the piezoelectric loudspeaker will now be described in detail while referring to the accompanying drawings.

Figure 1:
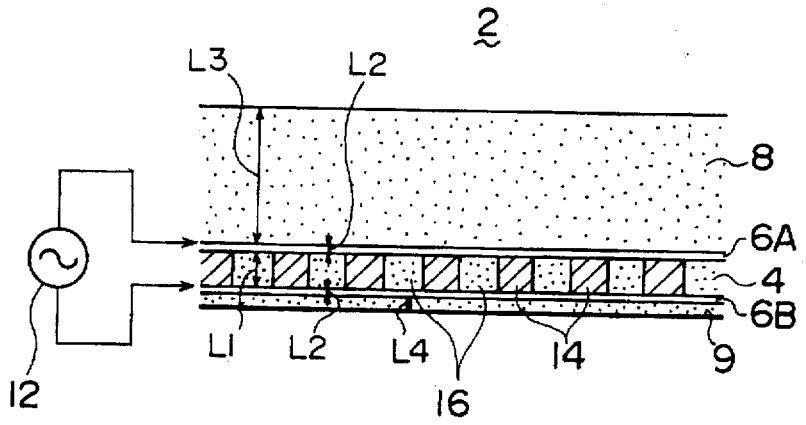
FIG. 1 is an enlarged cross-sectional view of the essential portion of a piezoelectric loudspeaker according to the present invention.
Figure 2:
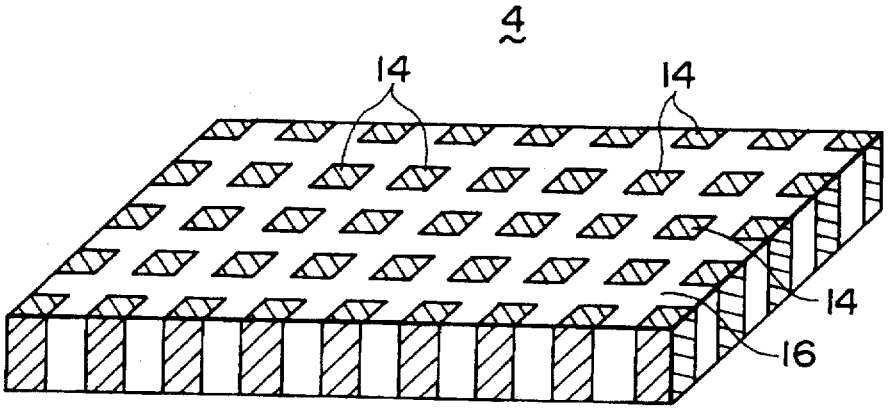
FIG. 2 is an enlarged perspective view of a compound piezoelectric sheet that is employed for the piezoelectric loudspeaker shown in FIG. 1.
Figure 3:
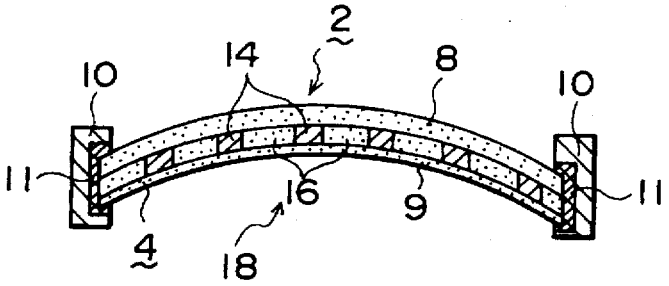
FIG. 3 is a cross-sectional view of the piezoelectric speaker.
Figure 5A:
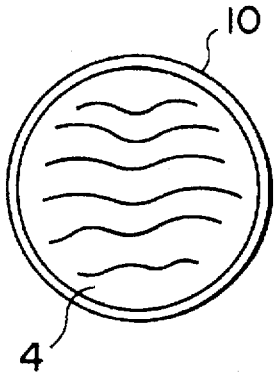
FIG. 5, composed of FIGS. 5A through 5F, is a diagram showing various support frame shapes for a piezoelectric loudspeaker.
Figure 5B:
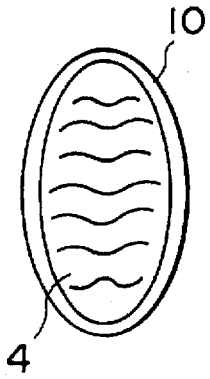
Figure 5C:
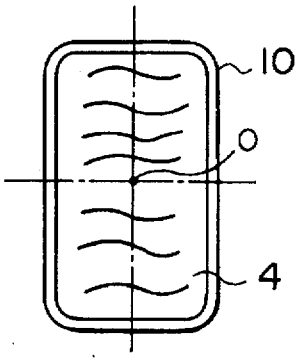
Figure 5D:
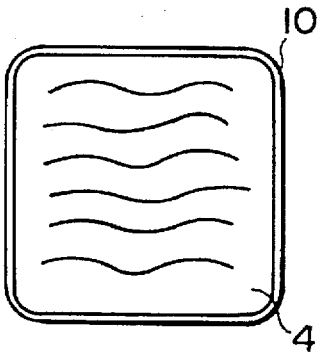
Figure 5E:
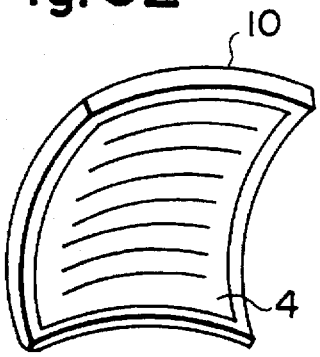
Figure 5F:
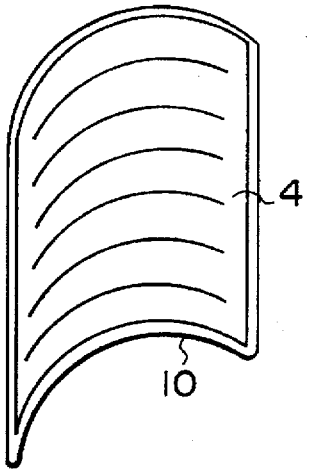
Figure 6:
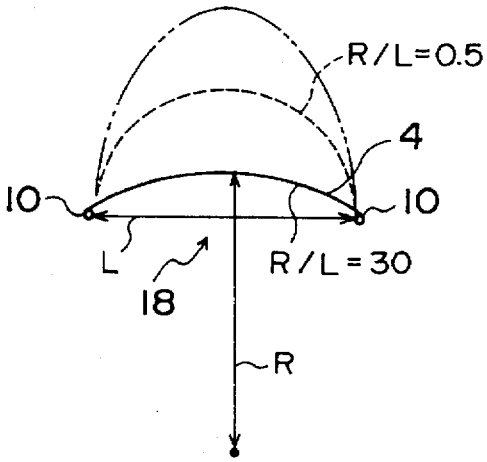
FIG. 6 is a schematic cross-sectional view for explaining the bending state of the compound piezoelectric sheet.

FIG. 1 is an enlarged cross-sectional view of the essential portion of a piezoelectric loudspeaker according to the present invention; FIG. 2 is an enlarged perspective view of a compound piezoelectric sheet that is employed for the piezoelectric loudspeaker shown in FIG. 1; FIG. 3 is a cross-sectional view of the piezoelectric loudspeaker; FIG. 4 is a diagram for explaining a method for forming a compound piezoelectric sheet; FIG. 5 is a diagram showing various support frame shapes for a piezoelectric loudspeaker; and FIG. 6 is a schematic diagram for explaining the bending state of a compound piezoelectric sheet for the piezoelectric loudspeaker.

As is illustrated, a piezoelectric loudspeaker 2 comprises a piezoelectric composite sheet i.e., compound piezoelectric sheet 4 that includes piezoelectric devices 14 and an organic material 16, two electrodes 6A and 6B that are fixed with an adhesive to the surfaces of the sheet 4, an acoustic impedance matching support layer 8 that is fixed with an adhesive to the surface of the electrode 6A, and a support frame 10 (see FIG. 3) that is formed of metal or resin, for example, and that supports the laminated body at its circumference. In the diagrams, a protective film 9 is fixed with an adhesive to the surface of the electrode 6B to protect the electrode from oxidization. When a tone signal is sent from a tone signal source 12 through lead lines (not shown) that are laid from the electrodes 6A and 6B, the compound piezoelectric sheet 4 is vibrated in the direction of its thickness due to the piezoelectric effect and tones are released. Although in FIG. 1 the individual components are formed flat for the explanation, actually, the entire sheet is bent with the matching support layer 8 having a convex shape, as is shown in FIG. 3. The piezoelectric sheet 4 is fixed to a support frame by using, for example, an adhesive 11.

To form the piezoelectric sheet 4, first, a PZT ceramic that has a thickness of 0.5 mm and that has been uniformly polarized in the direction of its thickness, is fixed to a flat machining jig plate. On its surface, a grid shaped series of grooves that are 0.3 mm deep are formed at a 0.1 mm pitch by a blade that is 0.2 mm thick. Then, an organic material, such as a polyurethane resin, an epoxy resin, or silicon rubber, is employed to fill the thus machined grid shaped series of grooves and is permitted to harden. The resultant structure is machined while in contact with the jig plate face, and material is removed by grinding until the face of the grid appears. FIG. 2 is a perspective view of the thus provided compound piezoelectric sheet 4. The shaded portions that have a square pillar shape represent the piezoelectric material i.e., piezoelectric devices 14, and the grid shaped portion that is fastened to them represents the polymer i.e., organic material 16. By selecting the thickness of a blade for matching and a groove pitch as needed, the volume ratio of the piezoelectric devices in the compound piezoelectric sheet 4 can be varied. Further, by specifying a different quality (hardness) for the organic material 16 that is used in the compound piezoelectric sheet 4, the degree to which the matching support layer 8 is required to perform the shape support function can be changed.

The electrodes 6A and 6B are formed of a conducting film, such as aluminum film, copper film, or Cr-Au film. The electrodes can be provided by ion plating or vacuum evaporation, for example, of a Cr-Au film of approximately 0.4 μm thick. As another electrode formation method, electroless copper of about 0.4 μm can be formed by plating, or a conducting film of from approximately several μm to several hundred μm thick can be formed by using a conducting paste. The acoustic impedance matching support layer 8, which is formed of a polyurethane resin, for example, has a matching function for properly transferring the vibration of the piezoelectric sheet 4 to the air, a shape supporting function for retaining in a bent state the piezoelectric sheet 4, which is very flexible, and an oxidization protecting function for preventing the electrode 6A, which is so internally provided, from oxidization. The optimal frequency property for reproduction is acquired by specifying the thickness, the material quality, and the hardness of the acoustic impedance matching support layer 8.

The protective film 9 is made of a comparatively soft and very thin organic material, such as a polyurethane resin. In this case, in contrast to the previous one, the matching support layer 8 may be made thinner and the protecting layer may be formed thicker. Either construction is acceptable as long as the matching support layer 8 and the protective layer 9 can together maintain the piezoelectric sheet 4 in its bent shape. As a specific example, in this embodiment thickness L1 of the piezoelectric sheet 4 is 0.2 mm, thickness L2 of both of the electrodes 6A and 6B is 0.3 μm, thickness L3 of the acoustic impedance matching support layer 8 is 3.0 mm, and thickness L4 of the protecting layer 9 is 0.1 mm.

Although the above described method for forming the compound piezoelectric sheet 4 employs a blade to form grooves that are then filled with an organic material, such grooves may be provided as is shown in FIG. 4. The illustrations in FIG. 4 show another method for forming a compound piezoelectric sheet. FIG. 4A is a plan view of a ceramic green sheet; FIG. 4B is a cross-sectional view of the ceramic green sheet in FIG. 4A; FIG. 4C is a diagram showing the state where cracking is performed in a ceramic flat plate that is obtained by annealing the ceramic green sheet; and FIG. 4D is a diagram showing the state where a resin is used to fill the cracks formed by the procedure in FIG. 4C.

Figure 4A:
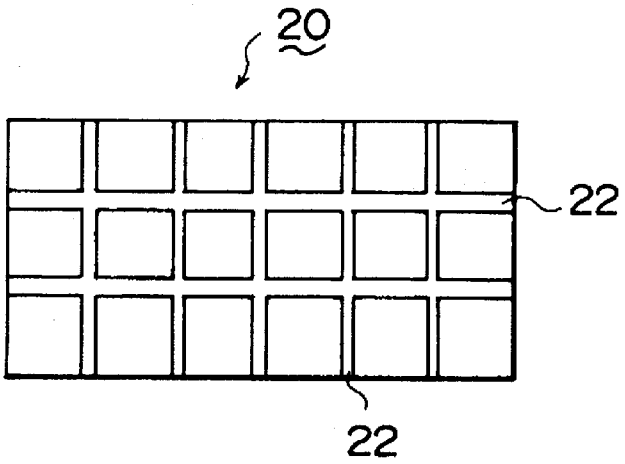
FIG. 4, composed of FIGS. 4A through 4D, is a diagram for explaining one method for forming a compound piezoelectric sheet.
Figure 4B:
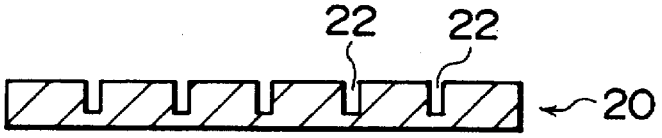

As is shown in FIGS. 4A and 4B, a grid frame (not shown) that is made of stainless steel or plastic is pressed against the surface of a comparatively soft PZT ceramic green sheet 20 that is about 0.5 mm thick and that is formed of a ceramic powder and an organic binder, and grooves 22 are formed in a grid shape thereon. At this time, as the grooves 22 that are formed do not reach the bottom of the ceramic green sheet 20, a slight portion of the sheet 20 remains that has not been cut, and the ceramic green sheet has not yet been separated into pieces.

Figure 4C:
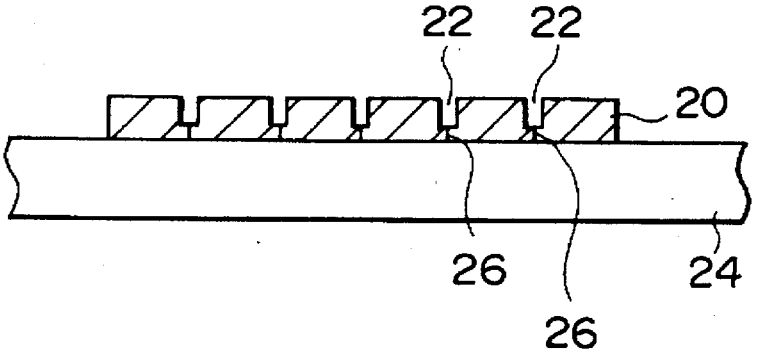

Then, the ceramic green sheet 20 in which the grooves have been formed halfway in the direction of the thickness is sintered at a predetermined temperature (1150° to 1250° C.). The sintered sheet 20 is mounted and is fixed with an adhesive to a flexible plate 24 that is made of a flexible member, such as rubber, as is shown in FIG. 4C. Then, the flexible plate is two-dimensionally extended, or is pressed against a grid frame (which is made smaller than the previously employed frame by taking into consideration the shrinkage percentage after the sintering process), and by applying pressure or employing impact, cracks 26 are formed under the grid shaped grooves 22. Thus, the ceramic green sheet 20 is divided into multiple ceramic pieces along the grooves.

Figure 4D:
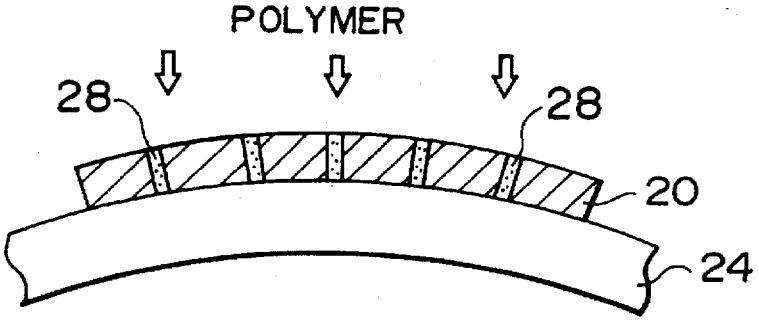

Sequentially, as is shown in FIG. 4D, the flexible plate 24 is extended to the sides and forward and backward in the manner that, for example, the flexible plate 24 is bent in an arc shape so that its face on which the ceramic green sheet 20 is mounted is slightly formed convex, and the grooves 22 and the cracks 26 are opened wider. In the condition, the organic material 24, such as a polyurethane resin, an epoxy resin, or silicone rubber, is filled from above in the grooves and the cracks 26. When this resin is solidified and the surface of the ceramic green sheet 20 is flattened, the same compound piezoelectric sheet as is shown in FIG. 2 can be provided.

According to this manufacturing method, complicated groove formation by using a blade, which takes much time, is not necessary, and a piezoelectric sheet can be manufactured easily with low costs. To change the volume ratio of the piezoelectric devices in the compound piezoelectric sheet, the width of the grooves is altered by selecting the thickness of the grid frame with which grooves are formed as needed.

The method for forming cracks in the annealed ceramic green sheet 20 is not limited to the above described method. Such cracks can be formed in the manner that, after the ceramic green sheet 20 is mounted on and is fixed with an adhesive to the flexible plate 24, by extending the flexible plate 24 on the flat plate, or by using a die and bending the ceramic green sheet 20 together with the flexible plate 24 into a spherical shape. Or, a specific procedure is performed in advance on the ceramic green sheet 20 that will prevent cracked pieces from scattering, and before it is mounted on the flexible plate 24, cracks are formed in the ceramic green sheet 20 and the cracked ceramic green sheet 20 is be mounted on the flexible plate 24.

Following this, the flexible plate 24 is bent and the grooves 22 is opened wide before an organic material is used to fill the grooves 22 and the cracks 26. In this case, the organic material is introduced into all the grooves 22 and the cracks 26 at the same time while they are opened wide by the bending of the flexible plate 24 into a spherical shape, or the organic material may be introduced into the grooves 22 and the cracks 26 along the vertical and horizontal directions by the bending of the flexible plate 24 in the directions that are perpendicular to each other. Of course, the polarization process for the piezoelectric devices 14 can be performed any time after the sheet is sintered.

The support frame 10 that supports the sheet around its circumference can be formed in various shapes. It can be formed, for example, in a circular shape, as in FIG. 5A, in an oblong shape, as in FIG. 5B, in an almost rectangular shape, as in FIG. 5C, in an almost square shape, as in FIG. 5D, or in a polygonal shape (not shown). The support frame 10 may be shaped by bending it three-dimensionally, as is shown in FIG. 5E. Further, as is shown in FIG. 5F, the compound piezoelectric sheet 4 may be bent so that it assumes the shape of a segment of a cylinder or the shape of a segment of a cylinder that has an oblong cross section, and the support frame 10 may be provided to hold the sheet 4 around its circumference.

As is described above, the compound piezoelectric sheet 4 is not flat but is bent into a dome shape. In a cross section of the opening 18 of the loudspeaker, as is shown in FIG. 6, in order to improve the sound pressure characteristics, the piezoelectric 4 is formed into a curved shape that is expanded beyond a spherical shape, which has a curvature radius R that is a predetermined number of times, for example, 30 times, larger than the width of the support frame 10, i.e., the string length L of the arched sheet cross section. The sound pressure characteristics especially can be substantially improved by specifying such a curved shape for the compound piezoelectric sheet 4.

The manufacturing method for the compound piezoelectric sheet 4 is not limited to the above described method, and another method can be employed. As an example, the compound piezoelectric sheet 4 may be formed as follows.

FIG. 7 is a diagram illustrating an additional method for manufacturing a compound piezoelectric sheet. As is shown in FIG. 7A, first, a comparatively soft ceramics green sheet 20 that consists of a ceramic powder and an organic binder is formed, annealed, and solidified to provide a sintered sheet 20. Then, this sheet 20 is bonded by using, for example, wide adhesive double coated tape 34, and is pressed from both sides by a press machine 36 to divide the sheet 20 and to form multiple piezoelectric devices 14, as is shown in FIG. 7B.

Figure 7A:
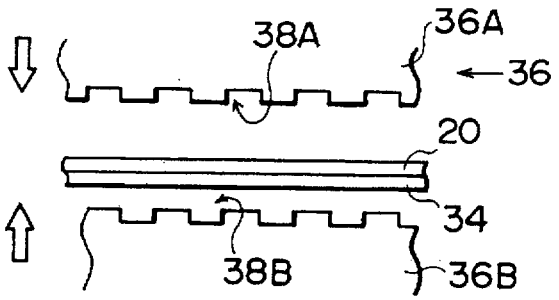
FIG. 7, composed of FIGS. 7A through 7E, is a diagram for explaining another method for forming a compound piezoelectric sheet.
Figure 7B:
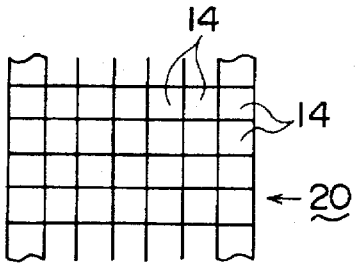

An upper die 36A and a lower die 36B of the press machine 36 have, for example, convex-concave pressing faces 38A and 38B with alternately raised and depressed portions that are arranged in a grid shape. The raised and the depressed portions of the pressing face 38A corresponds to the depressed and the raised portions of the pressing face 38B respectively , i.e., the pressing faces 38*a* and 38*b* form a number of sets that each comprise a male die and a female die. Therefore, when the sintered sheet 20 is sandwiched between the dies 36A and 36B of the press machine 36, the sintered plate 20 can be so divided that it assumes an almost grid shape, as is shown in FIG. 7B.

It should be noted that the piezoelectric devices 14 that are formed by dividing the sheet 20 will not scatter because the sheet 20 is held by the wide tape 34.

Figure 7C:
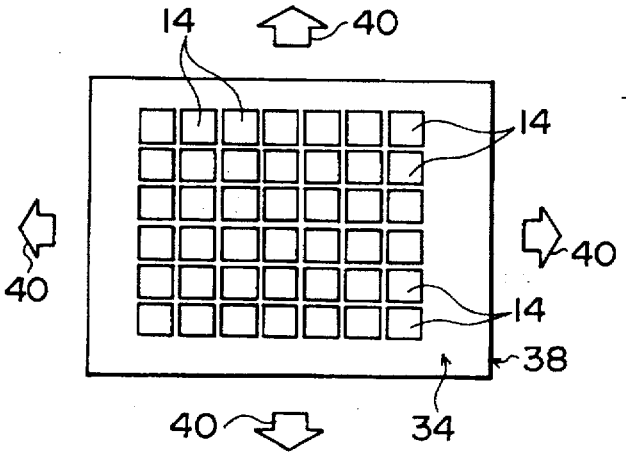

Sequentially, as is shown in FIG. 7C, the tape 34 is mounted onto an elastic body 38, such as silicone rubber, that is extended in the directions that are indicated by arrows 40 to expand its area, and the intervals for the adjacent piezoelectric devices 14 are slightly longer by a predetermined length.

Figure 7D:
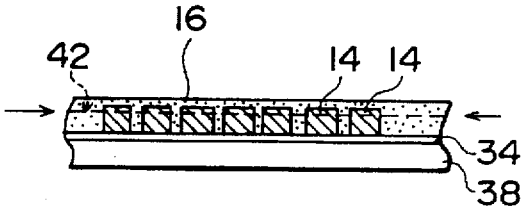

Then, as is shown in FIG. 7D, the organic material 16 is introduced into the gaps between the piezoelectric devices 14 in the same manner as before, and is hardened. It should be noted that FIG. 7D is a cross-sectional view in the direction of the thickness of the sheet.

Figure 7E:
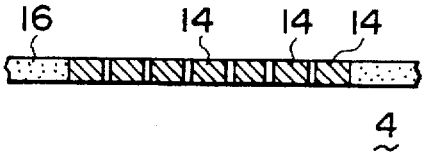

Since the entire surface of the sheet will be covered with the organic material 16 if it is simply is left to harden, as is performed in the above described example, the surface is ground to a grinding line 42 in FIG. 7D and the heads of the piezoelectric devices 14 are exposed, thereby providing the compound piezoelectric sheet 4 that is shown in FIG. 7E. After the grinding is completed, the elastic body 38 and the adhesive double coated tape 34 are naturally removed. Further, the polarization process for the piezoelectric devices 14 can be performed any time after the sheet 20 has been sintered.

According to this example, the compound piezoelectric sheet 4 can also be easily manufactured and manufacturing costs can be drastically reduced. Although, in this embodiment, the entire structure is mounted on the surface of the elastic body 38 of silicone rubber after being pressed, the elastic rubber 38 may also be fixed to the lower face of the adhesive double coated tape 34 and be pressed by the press machine 36.

Figure 8:
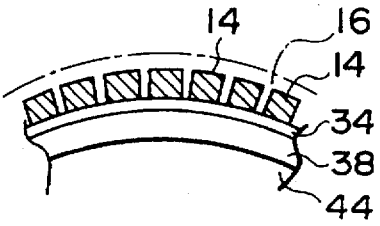
FIG. 8 is a diagram for explaining a method for filling spaces between piezoelectric devices with an organic material.

Although, as is shown in FIG. 7C, the elastic body 38 is extended to separate the adjacent piezoelectric devices 14 the separation method is not thereby limited so. For example, as is shown in FIG. 8, the elastic body 38, on which the divided sheet 20 is placed, can be mounted on the surface of a curved jig 44, which has a spherical curved face, and be so extended that the adjacent piezoelectric devices 14 are separated. In such a condition where the piezoelectric devices 14 are located at the intervals, an organic material 16 need only be introduced into the gaps between the piezoelectric devices 14 and allowed to harden.

Figure 9:
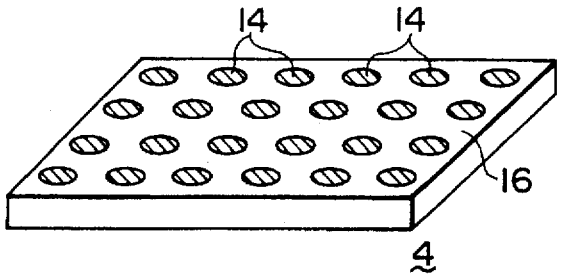
FIG. 9 is a perspective view of a compound piezoelectric sheet for which cylindrical piezoelectric devices are employed.

In the above described embodiment, an explanation has been given by employing the piezoelectric devices that are formed as a rectangular parallelpiped or a cube with an almost square cross section. The piezoelectric device is not limited to these shapes, however, and may be formed with a polygonal cross section, or as is shown in FIG. 9, with a cylindrical shape. According to the illustrations, the piezoelectric devices are aligned vertically and horizontally. However, the arrangement of the piezoelectric devices is not limited to this, and they may be arranged elaborately, for example, by providing one more piezoelectric devices in the center of every four of the piezoelectric devices that are shown in FIG. 9.

A further method for manufacturing a compound piezoelectric sheet where cylindrical piezoelectric devices are formed will now be described while referring to FIG. 10.

Figure 10A:
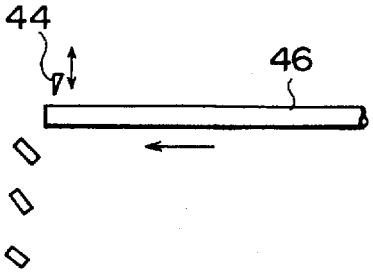
FIG. 10, composed of FIGS. 10A through 10F, is a diagram for explaining an additional method for forming a compound piezoelectric sheet.
Figure 11:
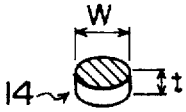
FIG. 11 is an enlarged perspective view of a piezoelectric device that is employed for the sheet in FIG. 9.

First, as is shown in FIG. 10A, a comparatively soft ceramics material 46 that consists of ceramic powder and an organic binder is pressed out in a cylindrical form by, for example, an extruder (not shown), and is cut into pieces having a predetermined thickness by a cutter 44. The cut pieces are then annealed to provide multiple piezoelectric pieces. FIG. 11 is a perspective view of the thus formed piezoelectric devices. The length (diameter) W is defined, for example, as about 1 to 2 mm and the thickness t is defined, for example, as approximately 0.5 mm.

Figure 10B:
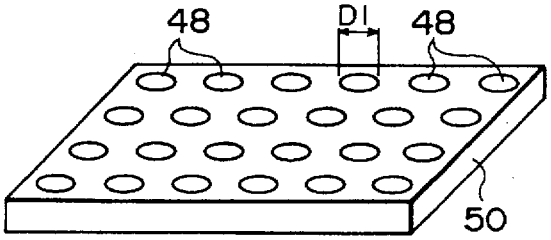
Figure 10C:
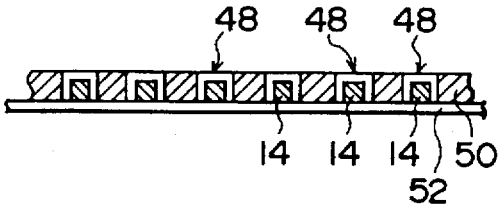

A metal or plastic sheet 50, which has multiple holes 48 in which piezoelectric devices are arranged, is prepared as is shown in FIG. 10B. Wide adhesive tape 52, for example, is attached to the bottom of the arrangement sheet 50, as is shown in FIG. 10C, and from the opposite side, the piezoelectric devices 14 shown in FIG. 11, which were formed previously, are dropped into the arrangement holes 48. In this case, diameter D1 of the holes 48 is set so that it is slightly larger than the length (diameter) W of the piezoelectric devices 14, so that a single piezoelectric device 14 can be fitted into each hole 48.

The piezoelectric device arrangement sheet 50 has the same thickness as thick as the thickness t of the piezoelectric devices 14, or is set so that it is slightly larger in order not only to facilitate the dropping of the piezoelectric devices 14 into it but make it easy to eliminate extra piezoelectric devices 14.

The dropping of the piezoelectric devices 14 into the arrangement holes 48 can be easily performed by alternately vibrating the piezoelectric device arrangement sheet 50 and inclining it in the direction of a plane face while many piezoelectric devices 14 are scattered across the upper face of the sheet 50.

Figure 10D:
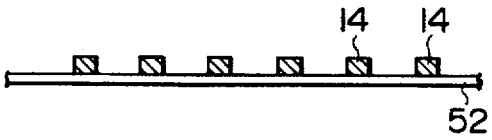

When the dropping of the piezoelectric devices 14 has been completed and the piezoelectric device arrangement sheet 50 is removed, as is shown in FIG. 10D, the piezoelectric devices 14 are aligned on the adhesive tape 52.

Figure 10E:
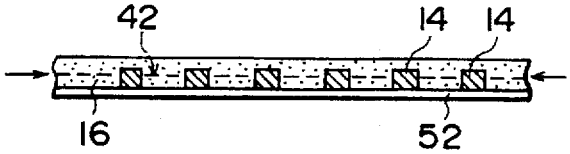
Figure 10F:
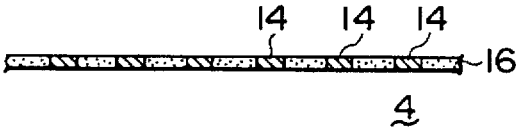

Then, as is shown in FIG. 10E, the organic material 16, which is the same as that which was previously employed, is applied to fill the gaps between the arranged piezoelectric devices 14 that it covers the surfaces of all the piezoelectric devices 14. When the organic material has hardened, it is ground down to the grinding line 42 to expose the head surfaces of the piezoelectric devices 14. Finally, the compound piezoelectric sheet 4 can be provided that is shown in FIG. 10F. The polarization process for the piezoelectric devices 14 can be performed any time after the ceramic material 46 is sintered.

Further, in order to arrange the cylindrical piezoelectric devices along a curve, it is possible for the piezoelectric device arrangement sheet 50 to be curved, then, when the adhesive tape 52 has been attached thereto, the piezoelectric devices 14 are dropped into the arrangement holes 48 and are arranged along the curved jig 44 that is shown in FIG. 8, which has a corresponding curved shape. Finally, by filling the gaps between the piezoelectric devices 14 with the organic material 16, a compound piezoelectric sheet having a curved shape can be formed.

In this case, the sheet 4 can be formed easily and the manufacturing costs can be substantially reduced.

The frequency properties and the output characteristics (sound pressure) of the piezoelectric loudspeaker are greatly affected by the volume ratio of the ceramic piezoelectric devices in the compound piezoelectric sheet, the organic material in the compound piezoelectric sheet, the material of the acoustic impedance matching support layer for improving tone quality, and the curvature of the compound piezoelectric sheet. Therefore, the optimal ranges for these components must be set.

Figure 12:
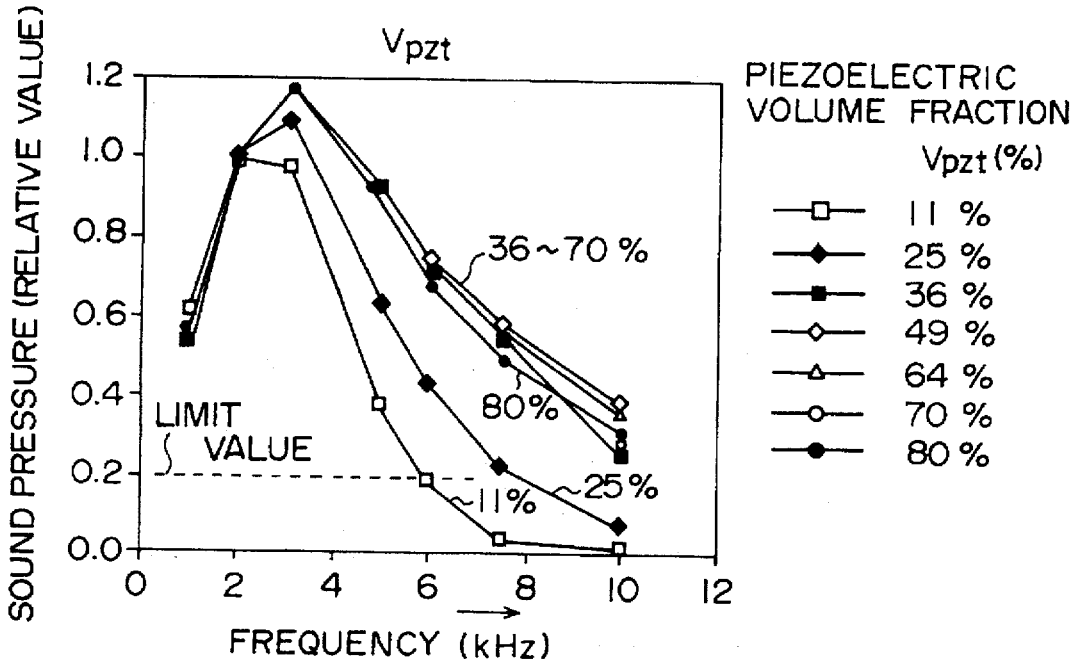
FIG. 12 is a graph showing the relationship between a frequency and sound pressure when the volume ratio of the piezoelectric devices in the compound piezoelectric sheet is varied.
Figure 13:
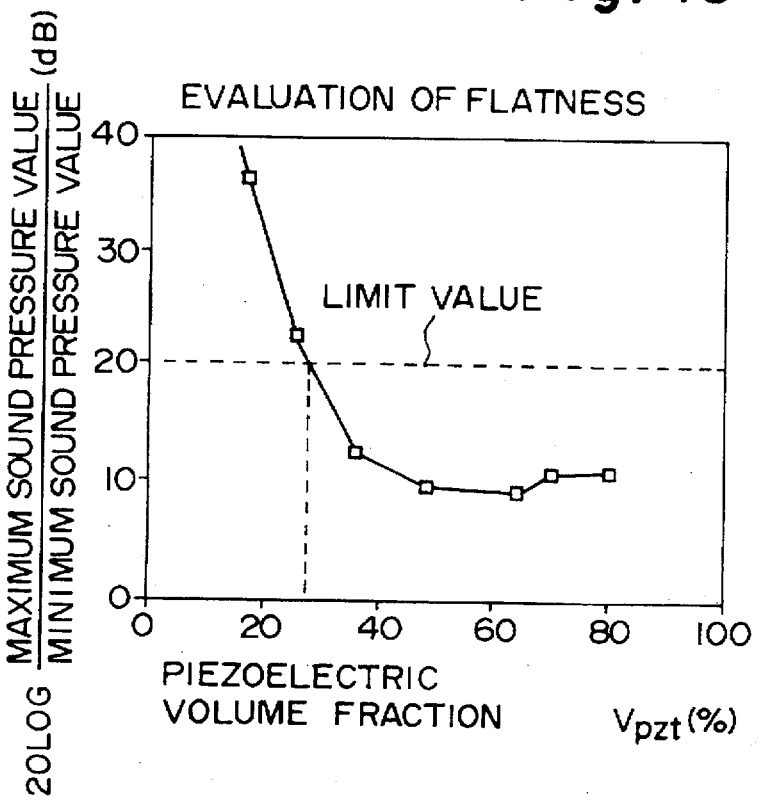
FIG. 13 is a graph showing a ratio gain between the maximum value and the minimum value of sound pressure relative to the volume ratio of the piezoelectric devices in the compound piezoelectric sheet.

The volume ratio of the ceramic piezoelectric devices 14 in the compound piezoelectric sheet 4 is set at 30% or higher. FIG. 12 is a graph showing the relationship between a frequency and sound pressure when the volume ratio (fraction) of the piezoelectric devices in the sheet is variously altered, and FIG. 13 is a graph showing the gain of a ratio of the maximum value to the minimum value of sound pressure, relative to the volume ratio of the piezoelectric devices in the compound piezoelectric sheet. The hardness of the acoustic impedance matching support layer is set to A79 according to the JIS (Japanese Industrial Standards), and polyurethane is employed for that layer. In this graph, relative values for the individual cases are acquired by using a frequency of 2 kHz as the standard.

As is apparent from FIG. 12, although sound pressure (relative value) peaks at about 2 kHz to 3 kHz, regardless of the volume ratio $V_{PZT}$ of the piezoelectric devices, when the volume ratio is small, such as 11% or 25%, the sound pressure in a high frequency area is too low, which is not preferable.

For reproduction, the sound pressure characteristic that affects efficiency is important. In addition, it is also important that the sound pressure be flat over a specific frequency range, i.e., the flatness must be preferable. The graph in FIG. 13 shows the gain of the ratio of the maximum value and the minimum value of sound pressure from 1 kHz to 10 kHz and evaluates the flatness. As the value for the sound pressure is smaller, the flatness is better. As is apparent from FIG. 13, in the range for the volume ratio of 30% or higher, the gain of the ratio of the maximum value of sound pressure to the minimum value is equal to or lower than 20 dB and the value of flatness is preferable. Taking the results in the graphs in FIGS. 12 and 13 into account, it is found that with the volume ratio of the piezoelectric devices of 30% or higher both the sound pressure and the flatness are desirable. Further, with the volume ratio for 40% to 80%, the flatness is 12 dB or lower and a more preferable characteristic is acquired.

For fabrication of the compound piezoelectric sheet 4, therefore, a proper thickness of the blade and a proper pitch for the grooves, into which an organic material is to be introduced, are selected and the volume ratio of piezoelectric devices should be so set that it is within the above described range.

For sound reproduction, the distortion and output of the reproduced sounds are also affected by the material, the hardness, and the thickness of the acoustic impedance matching support layer 8 (see FIG. 1). In order to provide an improved acoustic impedance and eliminate no distortion, and to maintain high output efficiency while the compound piezoelectric sheet is maintained in a curved shape, the sum of the thicknesses of the protective film 9 and of the matching support layer 8 is set so that it falls within the range of from 0.5 mm to 5.0 mm, and a comparatively soft material with the hardness of JIS-A60 to A90 is employed for these components.

Figure 14A:
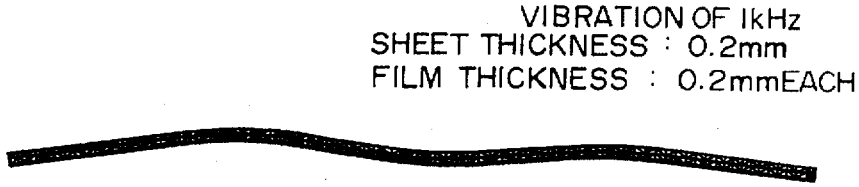
FIG. 14, composed of FIGS. 14A through 14E, is a diagram showing the vibration state attained by computer simulation.
Figure 14B:
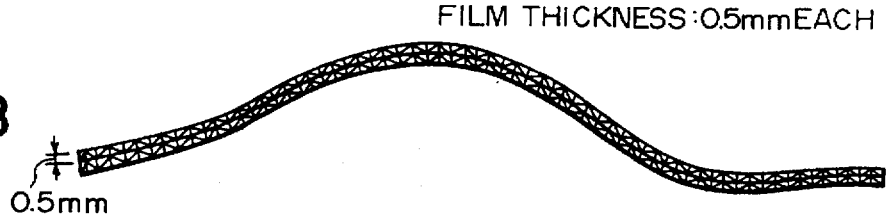
Figure 14C:
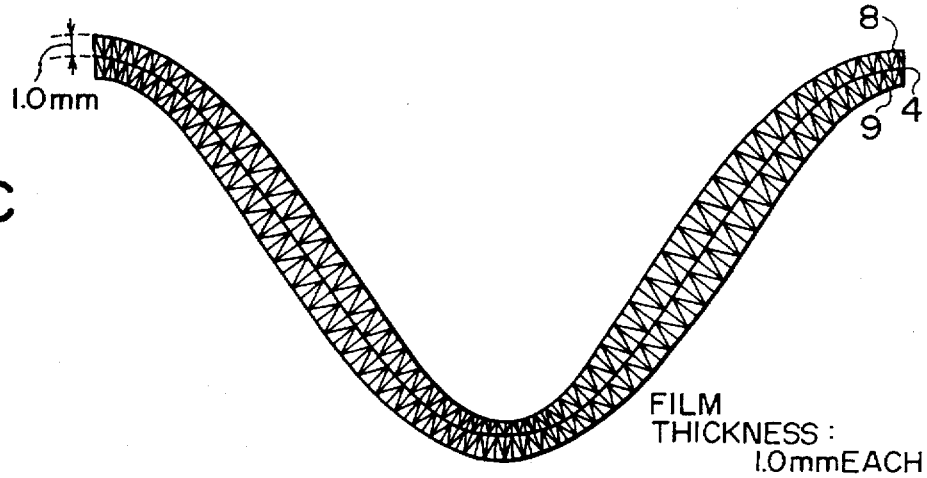
Figure 14D:
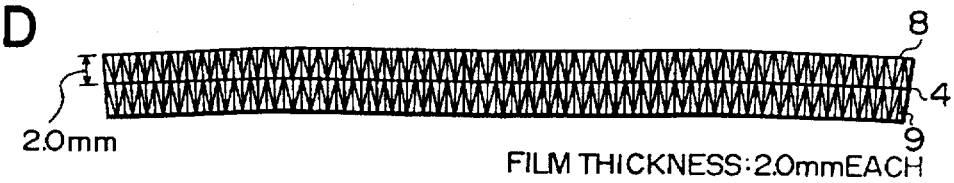
Figure 14E:
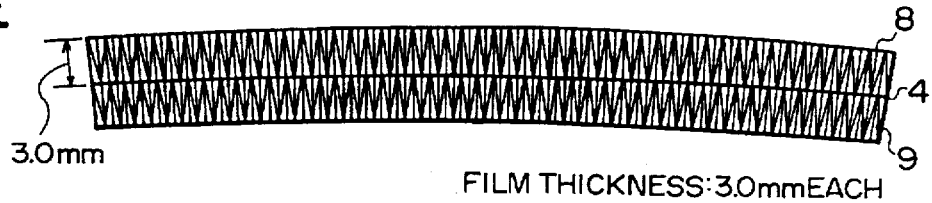

This will be specifically explained based on computer simulation. The illustrations in FIG. 14 show vibration states using computer simulation. FIG. 14A is a diagram showing the vibration state when a comparatively soft resin, i.e., a polyurethane resin, having a thickness of 0.2 mm is formed as a matching support layer 8 on both surfaces of a compound piezoelectric sheet 4 having a thickness of 0.2 mm. FIG. 14B is a diagram showing the vibration state when each of the polyurethane resin layers that is formed on the surfaces has a thickness of 0.5 mm. FIG. 14C is a diagram showing a vibration state when each of the polyurethane resin layers has a thickness of 1.0 mm. FIG. 14D is a diagram showing the vibration state when the polyurethane resin layers have a thickness of 2.0 mm. And FIG. 14E is a diagram showing the vibration mode when the polyurethane resin layers have a thickness of 3.0 mm. The curvature radius of the piezoelectric sheet in each diagram is set at 200 mm, a forcible vibration frequency is set at 1 kHz, and one of the polyurethane resin layers serves as a protective film. The displacement of the individual states are shown enlarged.

As is apparent from these diagrams, when the protective film 9 and the matching support layer 8 are too thin, vibration having an opposite phase occurs, and a harmonic is also caused, which is not preferable for the characteristic. This is because an excessively thin support layer can not maintain the curved shape of the piezoelectric sheet, and the vibration state is not stable (see FIGS. 14A and 14B).

On the other hand, when the protective film 9 and the matching support layer 8 are thick (see FIGS. 14C and 14D), the vibration state has no opposite phase and becomes stable. When a comparatively hard epoxy resin is employed as an organic material in the piezoelectric sheet, steady vibration can be acquired even with a matching support layer of about 0.1 mm.

However, when the thickness of the matching support layer 8 is excessively large (see FIG. 14E), the amplitude becomes small, the sensitivity is reduced, and efficiency is lowered. It is therefore determined that the sum of the thicknesses of the protecting film 9 and of the matching support layer 8 should not be excessively large.

Figure 15:
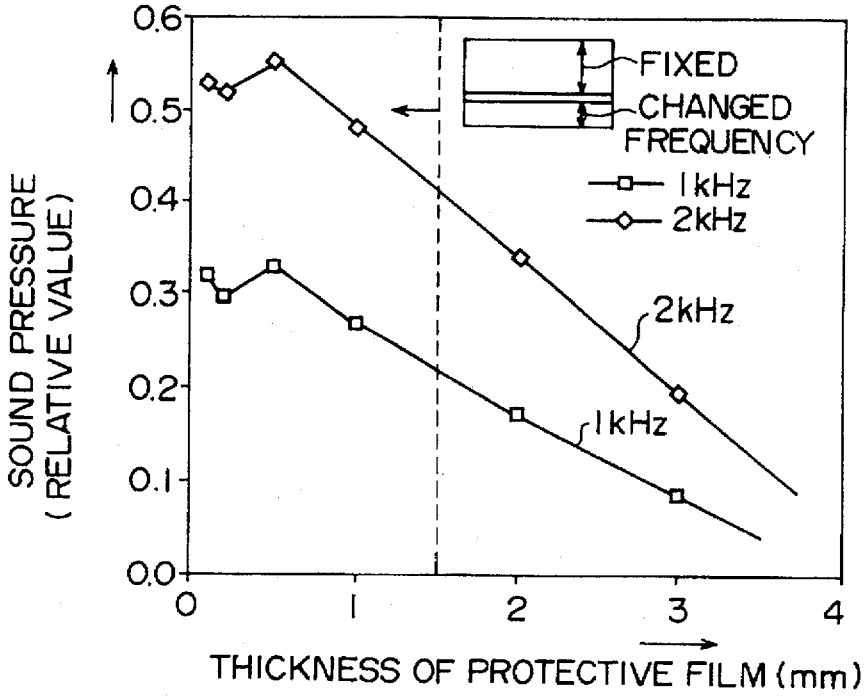
FIG. 15 is a graph showing the relationship between the thickness of a protective film and sound pressure when the thickness of an acoustic impedance matching support layer is constant.

In this case, if the thickness of the protective film 9 on one surface is reduced to half or less than that of the matching support layer 8 on the other surface, the sensitivity can be increased and sound pressure can be set high. For an explanation of this, the graph in FIG. 15 shows sound pressure (relative values) when the thickness of the matching support layer 8 on one face is fixed at 3.0 mm and the thickness of the protective film 9 on the other face is varied. As is apparent from this graph, as the thickness of the protective film 9 is smaller, the sensitivity is increased, the sound pressure is raised, and a preferable characteristic is acquired. Especially, when the thickness of the protective film 9 is reduced to half or less than that of the matching support layer 8 (1.5 mm or less in the graph), high output efficiency can be maintained while the vibration is steady.

Figure 16:
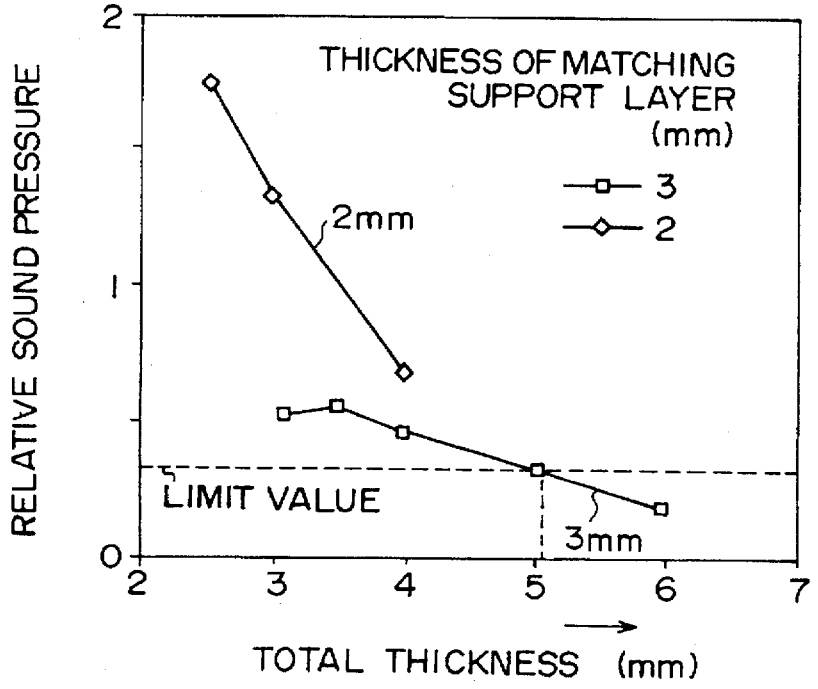
FIG. 16 is a graph showing relative sound pressure when the thickness of the protective film is altered and the total thickness is changed while the thickness of the matching support layer is fixed.

The sum of the thicknesses of the matching support layer 8 and of the protective film 9 will be discussed. The graph in FIG. 16 shows relative sound pressure at a frequency of 2 kHz when the thickness of the matching support layer 8 is fixed at 2 mm and at 3 mm while the thickness of the protective film is varied. According to this graph, when the sum of the film thicknesses exceeds 5.0 mm, the sensitivity drastically drops and relative sound pressure falls below the limit value, so that this case is found to be not preferable.

Therefore, as is shown in FIG. 1, on one face, a protective film 9 of polyethylene resin is deposited that has a thickness (about 0.1 mm) which is only enough to prevent the oxidization of the electrode 6B, while on the other face, a matching support layer 8 of polyurethane resin is deposited that has a sufficient thickness (about 3.0 mm). The relative sound pressure characteristic can be optimized.

Figure 17:
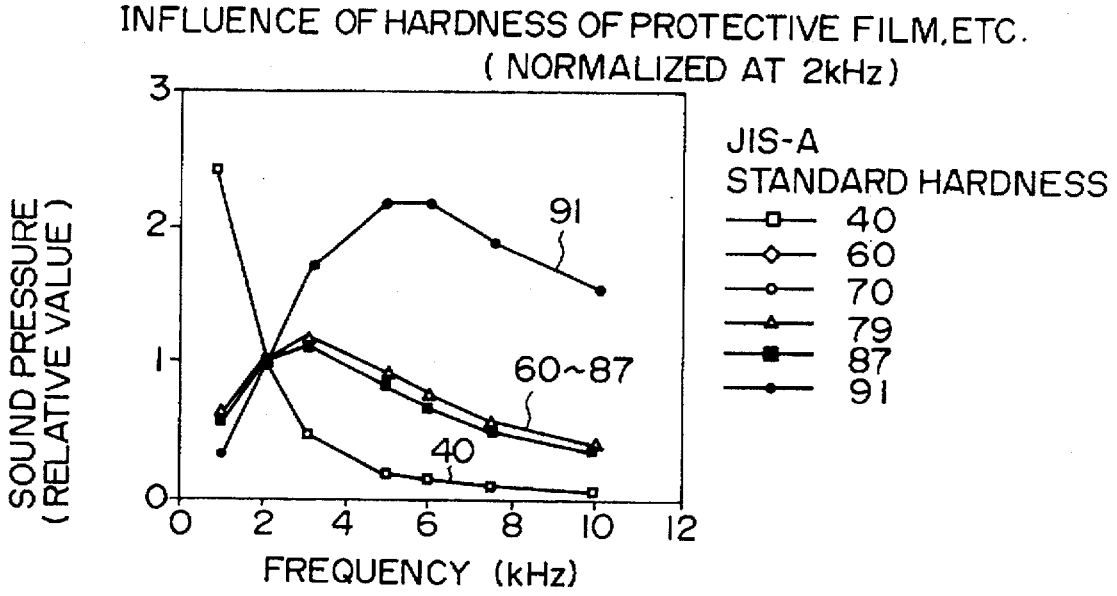
FIG. 17 is a graph showing the change of sound pressure relative to a frequency when the hardness of the acoustic impedance matching support layer is varied.
Figure 18:
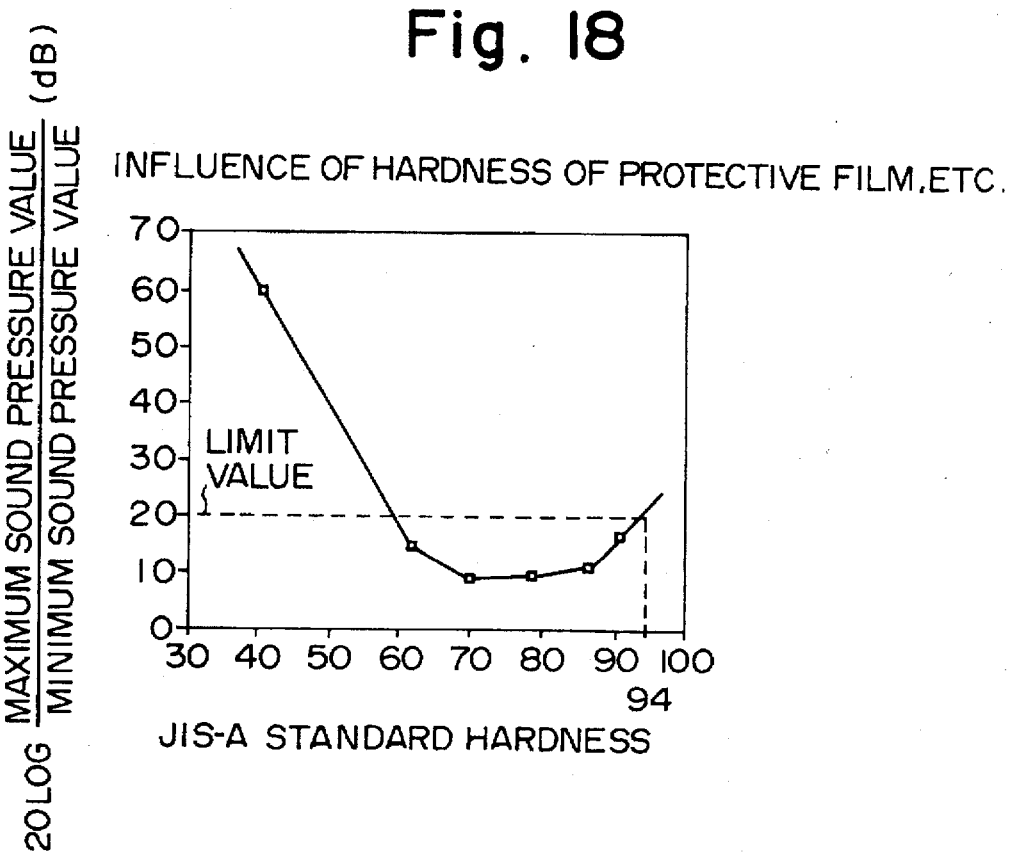
FIG. 18 is a graph showing the ratio gain between the maximum value and the minimum value of sound pressure relative to the hardness according to the JIS-A standards.

As for the hardness (JIS-A standards) of the matching support layer at this time, the graph in FIG. 17 shows the change in the sound pressure (relative value) relative to a frequency when the hardness of the matching support layer is changed, and the graph in FIG. 18 shows the gain of the ratio of the maximum value of sound pressure to the minimum value within the range of from 1 kHz to 10 kHz, with respect to the JIS-A standard hardness, and represents the evaluation of the flatness. As is apparent from FIGS. 17 and 18, as the hardness of the matching support layer is increased, the sound pressure is raised, which is preferable. When the hardness is A94 according to the JIS-A standards, however, the sound pressure is changed too much and the flatness is deteriorated. As for the gain of the ratio of the maximum value of sound pressure to the minimum value, the gain is increased and the flatness is reduced whenever the matching support layer is harder or softer, with a hardness of JIS-A70 as the minimum value. Therefore, the hardness range for satisfying both the sound pressure characteristic and the flatness characteristic must be JIS-A60 to JIS-A94, as is previously described.

The matching support layer 8 eliminates harmonics and distortion by matching an acoustic impedance with the atmosphere, and expands a reproduced tone range. However, when the functions of the matching support layer 8 are excessive, the output is reduced and the efficiency is deteriorated. Thus, it is preferable that a comparatively hard resin, such as an epoxy resin, be employed as an organic material in the compound piezoelectric sheet 4 so as to increase its mechanical strength, and that a comparatively soft resin, such as polyurethane resin, be employed as the matching support layer 8 so as to match the acoustic impedance with the atmosphere.

When the mechanical strength of the piezoelectric sheet 4 is increased, the matching support layer 8, which performs the shape maintenance function, can be thinner within the range in which the acoustic impedance characteristic is not deteriorated. Accordingly, the output characteristic can be prevented from deteriorating and the output efficiency is increased. When a hard epoxy resin, for example, is employed as an organic material for the compound piezoelectric sheet to increase its mechanical strength, the sum of the thicknesses of the matching support layer 8, which performs the shape maintenance function, and of the protective layer 9 can be reduced to 0.1 mm.

A broad reproduced tone range can be acquired by providing such an appropriate matching support layer 8 that sounds frequencies in not only a high tone range but also in a middle tone range can be reproduced by a single loudspeaker, so that the loudspeaker can serve as a tweeter and a squaker.

In addition, the output characteristic for reproduction is greatly affected by the curvature radius of the vibrating body of the loudspeaker. The curvature of the compound piezoelectric sheet, which is a vibrating body, is set to a predetermined value or greater. An explanation of this will be given below. FIG. 19 is a graph showing example vibration states obtained by computer simulation when the curvature radius R of the compound piezoelectric sheet is 200 mm and 500 mm. FIG. 20 is a graph showing the relationship between the sound pressure (relative value) and the ratio of the curvature radius R of the compound piezoelectric sheet and string length L (see FIG. 6) in a cross section of the sheet.

Figure 19A:
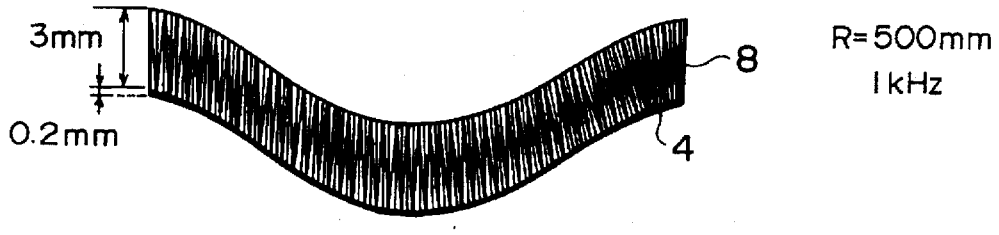
FIG. 19, composed of FIGS. 19A and 19B, is a diagram showing examples of the vibration state obtained by computer simulation when the curvature radius of the compound piezoelectric sheet is 200 mm and 500 mm.
Figure 19B:
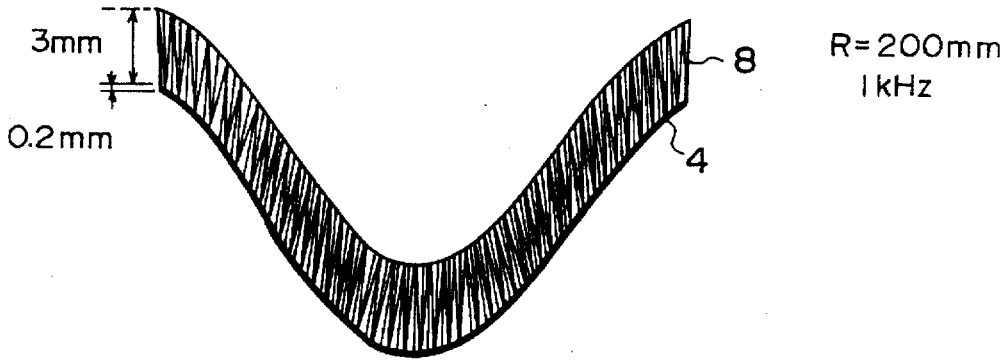
Figure 20:
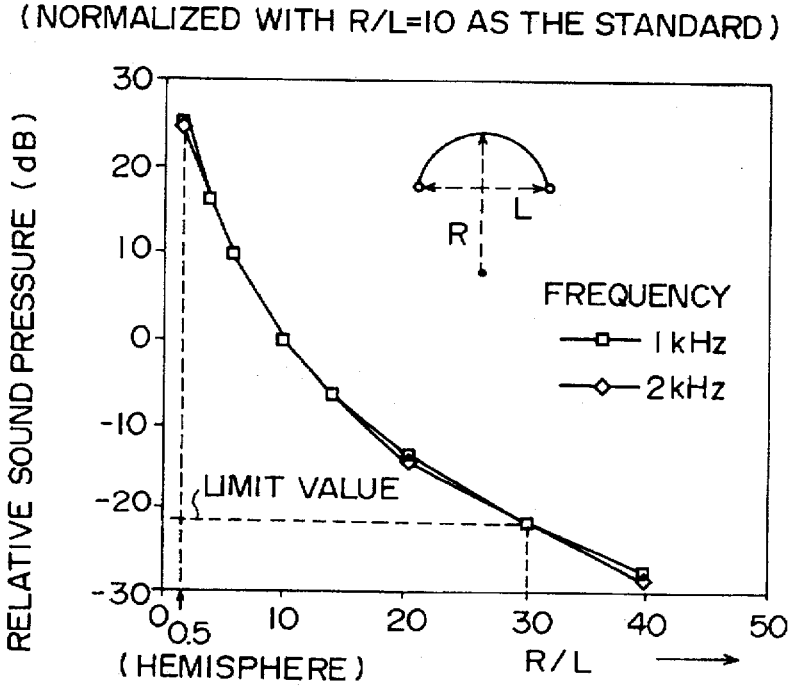
FIG. 20 is a graph showing the relationship between the sound pressure and the ratio of the curvature radius R of the compound piezoelectric sheet and the string length L of the corresponding sheet cross section.

The illustration in FIG. 19A shows the vibration state for a curvature radius R of 500 mm, and the illustration in FIG. 19B shows the vibration state for a curvature radius R of 200 mm. The thickness of the piezoelectric sheet is set at 0.2 mm, the thickness of the protective film 9 is 0.1 mm, and the thickness of the matching support layer 8 is 3.0 mm. As is apparent from the illustrations, when the curvature radius R is small, i.e., when the curvature of the bending face is large, the amplitude is increased and the output characteristic efficiency is raised.

In FIG. 20, the above described tendency clearly appears. When R/L is decreased, i.e., when the compound piezoelectric sheet 4 is expanded vertically in FIG. 6, the sound pressure (output) is drastically increased and the efficiency becomes greater. This is because, with the string length L being constant, as the curvature radius R is reduced and the piezoelectric sheet is expanded more, the volume of the piezoelectric devices in the piezoelectric sheet is increased, and the electromechanical conversion efficiency and the effects that are due to the curve of the vibrating face are improved.

The R/L ratio relative to the lower limit value of sound pressure of a common electromagnetic loudspeaker is about 30, and the cross section of the sheet in this case is indicated by the solid line in FIG. 6. Thus, when the curved shape of the sheet is set to the shape that is specified by expression $R/L \leqq 30$ (the shape that is expanded vertically more than the sheet curved face that is specified by $R/L=30$), the high sound pressure characteristic can be acquired. Preferably, the sheet should be formed so that it can be expanded more than the curved face of the sheet that is specified by $R/L=20$. More preferably, R/L should be set in the range of from 0.5 to 5.0. The curve for $R/L=0.5$, which is indicated by the broken line, is a semi-arc with the string length L as a diameter, but the bending shape of the sheet is not limited to an arched shape in cross section, and may have an oblong shape in cross section that is further expanded (indicated by the chain double-dashed line in FIG. 6). The bending shape of the sheet in this case is oblong in a revolved section. The expression of $R/L \leqq 30$ must satisfy the cross-sectional shapes in any direction that runs across the center of the support frame 10 in FIG. 5. In the rectangular support frame 10 in FIG. 5C, for example, the above expression must be established for any of its cross sections taken along the vertical direction and the horizontal direction across the center.

In the support frame 10 shown in FIG. 5F, the cross section taken along the horizontal direction must satisfy the above expression.

As described above, when the expanded state of the curved shape of the compound piezoelectric sheet is set to a predetermined size or greater, high sound pressure (output) during reproduction and high efficiency can be maintained.

The cross sectional shape of the sheet does not need to be an exact arc or an exact oblong, and may be slightly deformed. Any degree of deformation can be accepted so long as the curved shape of the sheet is so expanded as to satisfy the above expression.

As other parameters, thickness t of the piezoelectric device 14, the hardness of the organic material 16 in the compound piezoelectric sheet 4, and ratio W/t of length (diameter) W of the piezoelectric devices 14 to the thickness t (see FIG. 11), and the hardness of the adhesive 11 for securing the sheet 4 to the support frame 10 were studied, and the following results were obtained.

Although thickness t of the piezoelectric device 14 has been set at 0.2 mm in the previous embodiment, through the study of various thicknesses t, it was determined that it should be 1.0 mm or less to acquire a predetermined sound pressure. When the thickness t exceeds that value, the sound pressure is considerably reduced, which is not a preferable result. It should be noted that, by employing a doctor blade method, a piezoelectric device with a thickness t of several μm can be easily manufactured.

As for the hardness of the organic material 16 of the compound piezoelectric sheet 4, through the study of various hardnesses, it was determined that the hardness of the organic material 16 should be set at A60 or greater according to the JIS-A standards in order to acquire a predetermined sound pressure. When the hardness of the organic material 16 is set excessively low, below A60, the displacement of the loudspeaker when it is driven is difficult to transmit, which is not a desirable result.

When the hardness of the organic material 16 is set to A90 or greater, the bending shape of the piezoelectric sheet 4 can be maintained and the acoustic matching support layer that is formed is thin, so that sound pressure can be increased and a preferable arrangement can be provided.

Figure 21:
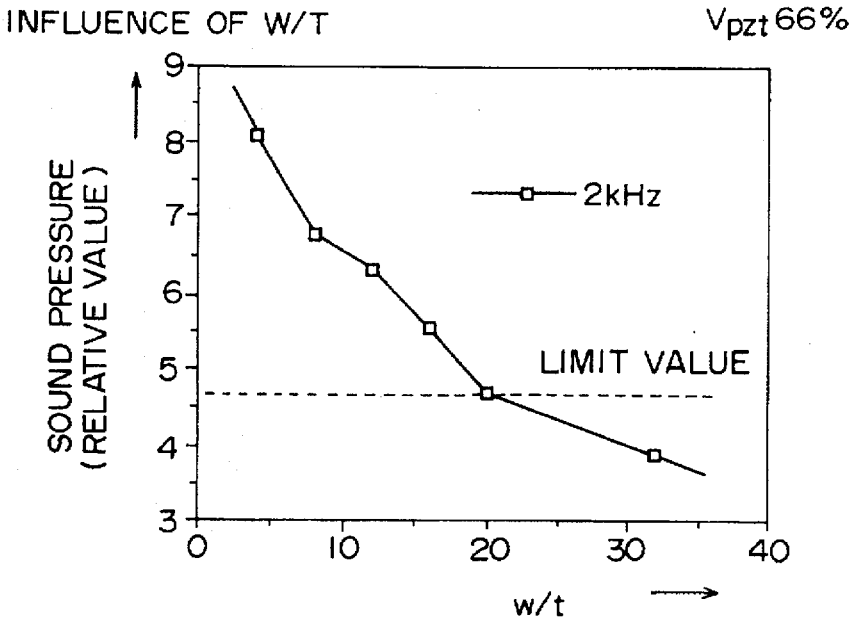
FIG. 21 is a graph showing the influence of the size ratio W/t of the piezoelectric device.

As for the ratio W/t of the piezoelectric device 14, sound pressure (relative value) at 2 kHz was examined by varying that ratio and the results shown in the graph in FIG. 21 were acquired. The ratio $V_{PZT}$ relative to the organic material 16 of the piezoelectric device 14 is 66%. The sound pressure is represented by normalizing it at 2 kHz.

Sound pressure which can be accepted for the employment of a loudspeaker is about 4.5 dB. As is apparent from the graph, when the ratio of W/t is set to 20 or lower, the preferable results can be acquired. In other words, when the ratio of W/t exceeds 20, the sound pressure is reduced until it is too low and preferable results can not be provided.

Figure 22:
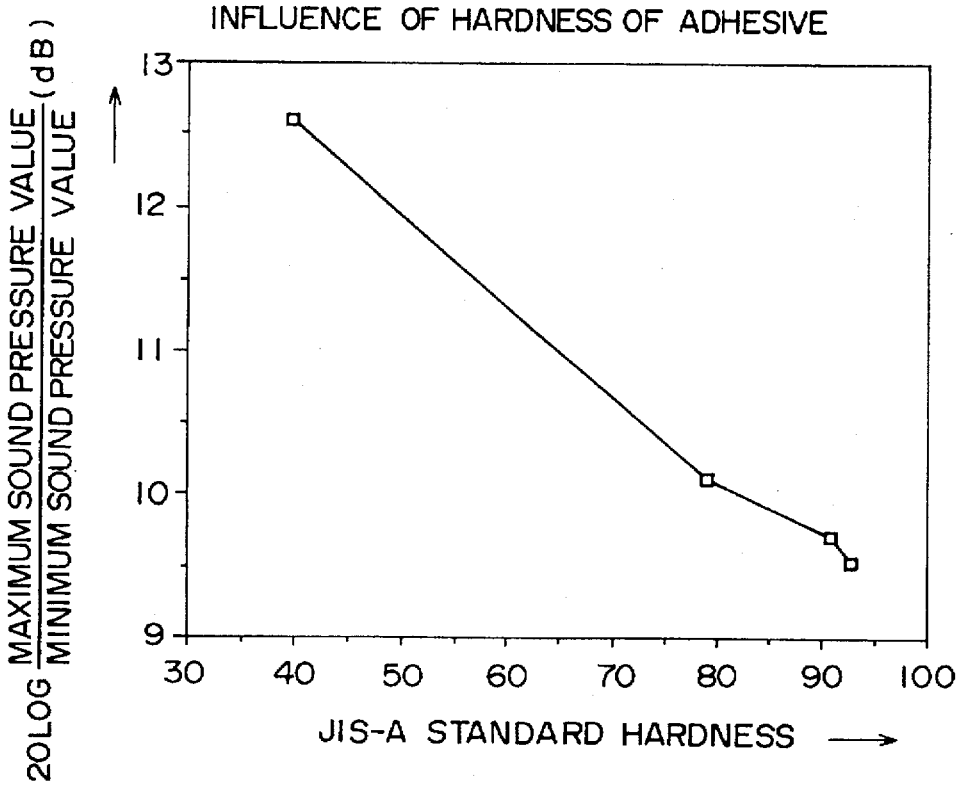
FIG. 22 is a graph showing the flatness achieved when the hardness of an adhesive is evaluated.

As for the hardness of the adhesive 11 which is employed for fixing the sheet 4 to the support frame 10, through the study that was conducted by varying the hardness, the results shown in the graph in FIG. 22 were acquired. This graph shows the relationship between the hardness of the adhesive 11 according to the JIS-A standards and the maximum value/minimum value of 20 Log sound pressure, and represents the evaluation of the flatness. For this evaluation, the frequency is set within the range of from 1 kHz to 10 kHz.

In this case, although the characteristic is considerably preferable at the sound pressure ratio of 20 dB or lower, when the used adhesive 11 is too soft, it is greatly displaced at the boundary with the support frame 10 and the vibration state is unsteady. According to the present invention, it is preferable that the circumference of the loudspeaker be securely fixed to the support frame 10, and the hardness of the adhesive 11 must be A70 or greater according to the JIS-A standards in order to stabilize the vibration state of the adhesive 11 at the boundary with the support frame 10.

Any adhesive that has the above described hardness, such as a polyurethane resin adhesive or an epoxy resin adhesive, may be employed. As the support layer 10, a plastic resin, metal, or wood may be employed.

Figure 23:
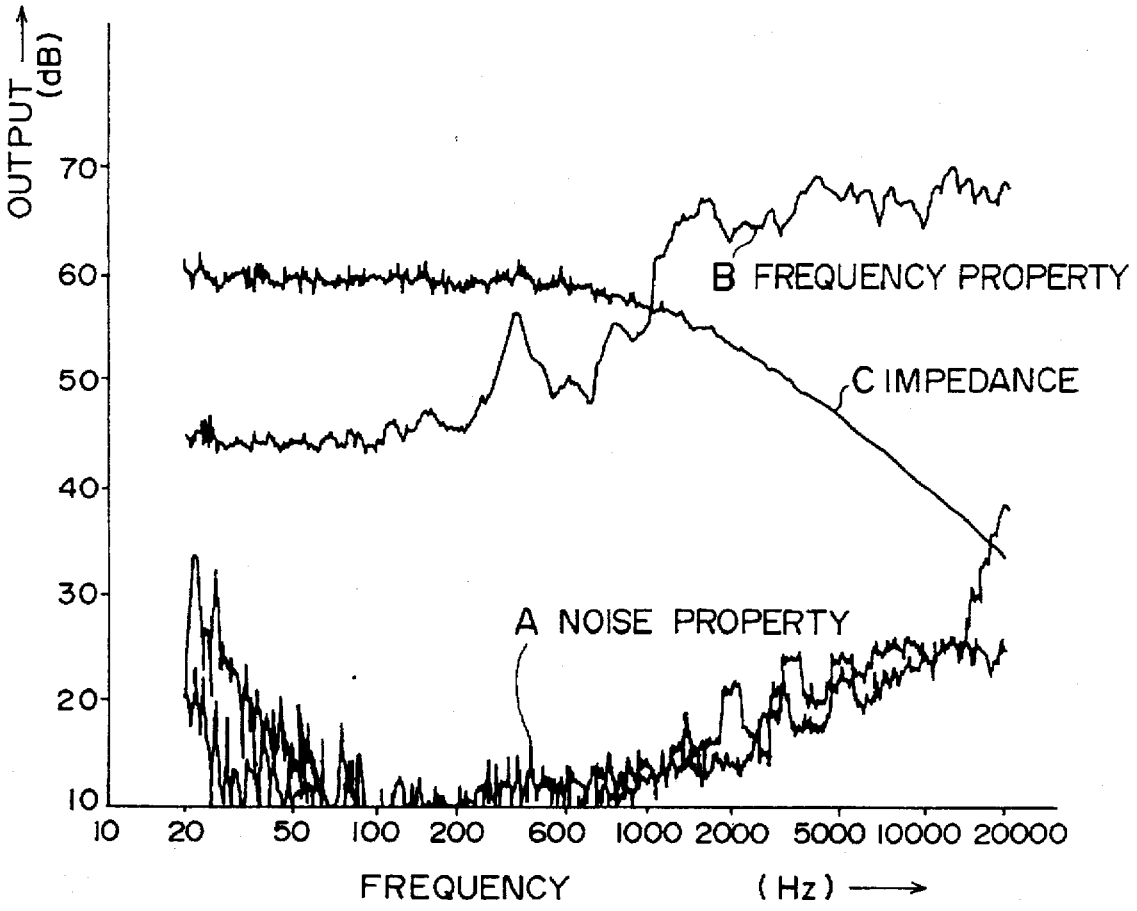
FIG. 23 is a graph showing the actual properties of the piezoelectric loudspeaker according to the present invention.

In the structure in FIG. 1, a polyurethane resin is used for an organic material in the piezoelectric sheet and the organic materials of the protective film 9 and the matching support layer 8. By using a loudspeaker for which such a piezoelectric sheet is set to 16 cm×16 cm, the frequency property was actually evaluated. The results are shown in FIG. 23.

In this graph, curve A represents a distortion (noise) characteristic, curve B represents a frequency property, and curve C represents an impedance characteristic. As is apparent from this graph, in the middle and high tone range of from 1500 to 20000 Hz, the sensitivity is preferable, a high sound pressure characteristic is shown, and the output is comparatively flat, which means high flatness (curve B). In this frequency range, the distortion is held low, and preferable results are obtained (curve A).

Figure 24:
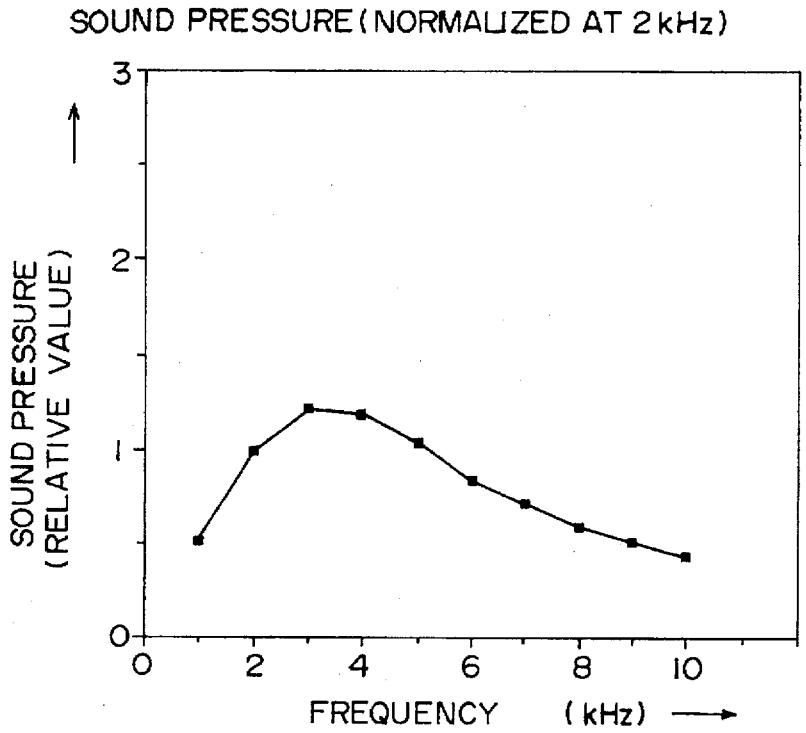
FIG. 24 is a graph showing a frequency and sound pressure when a preferred loudspeaker according to the present invention is evaluated.
Figure 26:
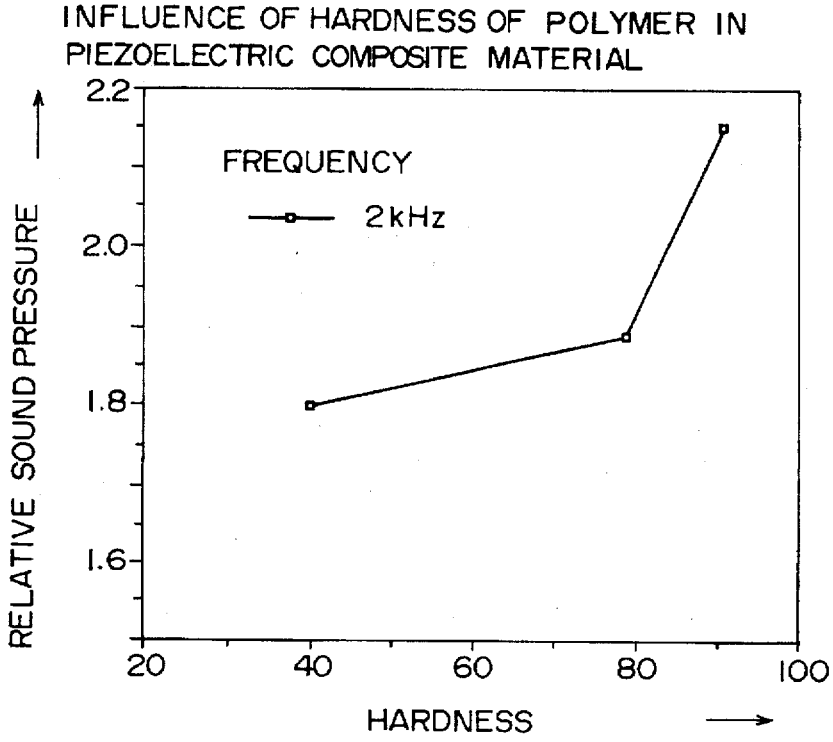
FIG. 26 is a graph showing the relationship between the hardness of the organic material in the compound piezoelectric sheet according to the JIS-A standards and sound pressure.

Further, the graph in FIG. 24 shows the relationship between a frequency and sound pressure (relative value) when another preferred loudspeaker is evaluated, and represents desirable results.

The requirements for the components in this case are as follows:

piezoelectric device: thickness t of 0.2 mm and W/t of 4.0 organic material in compound piezoelectric sheet: hardness of A91 according to the JIS-A standards R: 100 mm L: 50 mm protective film on upper face (convex face): hardness of A79 according to the JIS-A standards and thickness of 2.5 mm protective film on lower face (protection of electrode): hardness of A79 according to the JIS-A standards and thickness of 0.1 mm adhesive to support layer: hardness of A91 according to the JIS-A standards volume ratio of piezoelectric devices: $V_{PZT}$=66%

The sound pressure is normalized at a frequency of 2 kHz and the flatness (20 Log sound pressure maximum value/minimum value) is 8.66 dB.

According to the present invention, the frequency property and the output characteristic of a loudspeaker can be improved and a loudspeaker having a desirable tone quality that saves space and energy can be provided. Therefore, the loudspeaker of the present invention can be employed as a loudspeaker for a liquid crystal wall-hanging television, a vehicle-mounted loudspeaker, a loudspeaker for a portable telephone, a large, flat loudspeaker, or any other loudspeaker that must be as thin as possible.

Although in the above embodiments, an explanation is given for a loudspeaker without a loudspeaker box, a box may be provided with the loudspeaker of the present invention. Further, another explanation has been given for a loudspeaker where the piezoelectric sheet is so bent that it protrudes on the side where the matching support layer is provided, as is shown in FIG. 3. However, this piezoelectric sheet is so formed to be bent in the opposite direction, i.e., to the side of the protective film.

Figure 25:
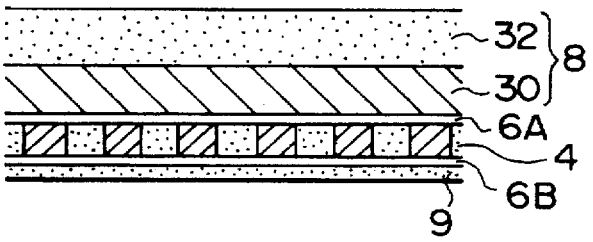
FIG. 25 is a diagram illustrating a modification of the acoustic impedance matching support layer.

In the above embodiments, the acoustic impedance matching support layer 8 consists of a single layer, such as a polyurethane resin layer, and has a shape maintenance function that maintains the curved shape of the compound piezoelectric sheet and a matching function that matches the acoustic impedance. The support layer 8 is not, however, thus limited. As is shown in FIG. 25, the matching support layer 8 may be formed of two layers: a shape maintenance layer 30 that maintains the shape of the compound piezoelectric sheet and a matching layer 32 that matches the acoustic impedance. In this case, material, such as a resin, with a hardness that is within the range of from A60 to A90 according to the Japanese Industrial standards is employed for the shape support layer 30. A silicon rubber resin or silicone varnish can be employed for the matching layer 32. In addition, when multiple shape support layers 30 and matching layers 32 are provided, the acoustic characteristic is naturally increased.

Although in the above embodiment, a loudspeaker that has a single, flat compound piezoelectric sheet has been explained, the structure is not limited to this. For example, multiple compound piezoelectric sheets having a predetermined shape may be arranged flat to constitute a single loudspeaker. With this structure, a frequency band in a middle tone range or a low tone range can be covered.

As is described above, the piezoelectric loudspeaker of the present invention and the methods for manufacturing it can provide the following excellent effects.

Since the acoustic impedance matching support layer is employed to maintain the compound piezoelectric sheet in a curved shape and to improve the tone quality, it is possible to provide a loudspeaker that has substantially improved frequency properties and output properties.

Thus, this piezoelectric loudspeaker can be utilized with an acoustic device that requires a compact, thin loudspeaker.

The present invention is not limited to the above described embodiments, but may be variously modified within the scope of the claims of this invention.

What is claimed is:

1. A piezoelectric loudspeaker comprising:

a compound piezoelectric sheet normally having a flat shape wherein multiple piezoelectric devices are arranged in an organic material;

an electrode provided on each face of said compound piezoelectric sheet;

an acoustic impedance matching support layer, extended to cover said electrodes, for maintaining said compound piezoelectric sheet in a curved shape and for matching an acoustic impedance, the acoustic impedance matching support layer being in direct contact with a face of the piezoelectric sheet; and a support frame for supporting said compound piezoelectric sheet around a circumference thereof.

2. A piezoelectric loudspeaker according to claim 1, wherein a protective film for protecting one of said electrodes is provided on a side opposite to that on which said acoustic impedance matching support layer is formed, the protective film being in direct contact with the face of the piezoelectric sheet.

3. A piezoelectric loudspeaker according to claim 2, wherein the thickness of said acoustic impedance matching support layer differs from the thickness of said protective film.

4. A piezoelectric loudspeaker according to claim 3, wherein the thickness of said protective layer is one half or less than the thickness of said acoustic impedance matching layer.

5. A piezoelectric loudspeaker according to claim 1, wherein when said organic material of said compound piezoelectric sheet is a polyurethane resin, the thickness of said acoustic impedance matching support layer is between 0.5 mm and 5.0 mm.

6. A piezoelectric loudspeaker according to claim 1, wherein when said organic material of said compound piezoelectric sheet is an epoxy resin, the thickness of said acoustic impedance matching support layer is between 0.1 mm and 5.0 mm.

7. A piezoelectric loudspeaker according to claim 1, wherein a volume ratio of said piezoelectric sheet is between 30% and 80%.

8. A piezoelectric loudspeaker according to claim 1, wherein a hardness of said organic material of said compound piezoelectric sheet is between A60 and A95 according to Japanese Industrial Standards.

9. A piezoelectric loudspeaker according to claim 1, wherein an adhesive for bonding together said compound piezoelectric sheet and said support frame has a hardness, after the adhesive is hardened, of between A70 and A94 according to Japanese Industrial Standards.

10. A piezoelectric loudspeaker comprising:

a compound piezoelectric sheet normally having a flat shape wherein multiple piezoelectric devices are arranged in an organic material;

an electrode provided on each face of said compound piezoelectric sheet;

an acoustic impedance matching support layer, extended to cover said electrodes, for maintaining said compound piezoelectric sheet in a curved shape and for matching an acoustic impedance;

a protective film for protecting one of said electrodes, said film being provided on a side of said piezoelectric sheet opposite to that on which said acoustic impedance matching support layer is formed, wherein the sum of the thicknesses of said acoustic impedance matching support layer and of said protective film is within the range of from 0.1 mm to 5.0 mm; and a support frame for supporting said compound piezoelectric sheet around a circumference thereof.

11. A piezoelectric loudspeaker comprising:

a compound piezoelectric sheet normally having a flat shape wherein multiple piezoelectric devices are arranged in an organic material;

an electrode provided on each face of said compound piezoelectric sheet;

an acoustic impedance matching support layer, extended to cover said electrodes, for maintaining said compound piezoelectric sheet in a curved shape and for matching an acoustic impedance, wherein said acoustic impedance matching support layer is formed of a comparatively soft polyurethane resin, and said organic material of said compound piezoelectric sheet is made of a comparatively hard epoxy resin; and a support frame for supporting said compound piezoelectric sheet around a circumference thereof.

12. A piezoelectric loudspeaker according to claim 11, wherein said comparatively soft resin has a hardness within a range of A60 to A95 according to Japanese Industrial Standards.

13. A piezoelectric loudspeaker comprising:

a compound piezoelectric sheet normally having a flat shape wherein multiple piezoelectric devices are arranged in an organic material;

an electrode provided on each face of said compound piezoelectric sheet;

an acoustic impedance matching support layer, extended to cover said electrodes, for maintaining said compound piezoelectric sheet in a curved shape and for matching an acoustic impedance, wherein said acoustic impedance matching support layer is formed of a comparatively soft resin, and said organic material of said compound piezoelectric sheet is made of a comparatively hard resin; and a support frame for supporting said compound piezoelectric sheet around a circumference thereof.

14. A piezoelectric loudspeaker comprising:

a compound piezoelectric sheet normally having a flat shape wherein multiple piezoelectric devices are arranged in an organic material, wherein a thickness of said piezoelectric devices is equal to or less than 1.0 mm;

an electrode provided on each face of said compound piezoelectric sheet;

an acoustic impedance matching support layer, extended to cover said electrodes, for maintaining said compound piezoelectric sheet in a curved shape and for matching an acoustic impedance; and a support frame for supporting said compound piezoelectric sheet around a circumference thereof.

15. A piezoelectric loudspeaker comprising:

a compound piezoelectric sheet normally having a flat shape wherein multiple piezoelectric devices are arranged in an organic material, wherein a ratio W/t of a width W of said piezoelectric devices to a thickness t is 20 or less;

an electrode provided on each face of said compound piezoelectric sheet;

an acoustic impedance matching support layer, extended to cover said electrodes, for maintaining said compound piezoelectric sheet in a curved shape and for matching an acoustic impedance; and a support frame for supporting said compound piezoelectric sheet around a circumference thereof.

16. A piezoelectric loudspeaker comprising:

a compound piezoelectric sheet having a flat shape wherein multiple piezoelectric devices are arranged in an organic material;

electrodes, each of which is provided on each face of said compound piezoelectric sheet;

an acoustic impedance matching support layer, extended to cover said electrodes, for maintaining said compound piezoelectric sheet in a curved shape and for matching an acoustic impedance; and a support frame for supporting said compound piezoelectric sheet at a circumference, wherein a curvature radius of said curved shape is equal to or less than 30 times of a string length of an opening of said compound piezoelectric sheet.

17. A piezoelectric loudspeaker according to claim 16, wherein a cross section that is taken across the center of said opening of said compound piezoelectric sheet in said curved shape is an almost arched shape.

18. A piezoelectric loudspeaker according to claim 16, wherein a cross section that is taken across the center of said opening of said compound piezoelectric sheet in said curved shape is an almost oblong shape.

19. A piezoelectric loudspeaker according to claim 16, wherein said compound piezoelectric sheet in said curved shape has a curve that constitutes a part of a cylinder with almost a circle in cross section or almost an oblong in cross section.

20. A piezoelectric loudspeaker according to claim 16, wherein a ratio R/L of a string length L of said opening and a curvature radius R of said curved shape is within a range of from 0.5 to 5.0.

21. A method, for manufacturing a piezoelectric loudspeaker, which comprises a compound piezoelectric sheet having a flat shape wherein multiple piezoelectric devices are arranged in an organic material; electrodes, each of which is provided on each face of said compound piezoelectric sheet; an acoustic impedance matching support layer, extended to cover said electrodes, for maintaining said compound piezoelectric sheet in a curved shape and for matching an acoustic impedance; and a support frame for supporting said compound piezoelectric sheet at a circumference, said piezoelectric sheet being manufactured by the steps of:

forming grooves halfway in the direction of thickness in a ceramic green sheet before sintering;

sintering said ceramic green sheet to provide a sintered sheet;

forming multiple piezoelectric devices by dividing said sintered sheet along said grooves; and filling said grooves with said organic material, while said piezoelectric devices are separated from each other, and hardening said organic material.

22. A method, for manufacturing a piezoelectric loudspeaker, according to claim 21, further comprising the step of grinding an extra portion of said organic material on the surface after said organic material is hardened.

23. A method, for manufacturing a piezoelectric loudspeaker, which comprises a compound piezoelectric sheet having a flat shape wherein multiple piezoelectric devices are arranged in an organic material; electrodes, each of which is provided on each face of said compound piezoelectric sheet; an acoustic impedance matching support layer, extended to cover said electrodes, for maintaining said compound piezoelectric sheet in a curved shape and for matching an acoustic impedance; and a support frame for supporting said compound piezoelectric sheet at a circumference, said piezoelectric sheet being manufactured by the steps of:

shaping, before sintering, comparatively soft ceramic material that consists of ceramic powder and an organic binder to employ the formation of said piezoelectric devices;

forming said piezoelectric devices by annealing said ceramics materials after shaped;

arranging said piezoelectric devices in a predetermined pattern by using a piezoelectric device arrangement plate that has multiple arrangement holes;

filling gaps between said piezoelectric devices with said organic material and hardening said organic material.

24. A method, for manufacturing a piezoelectric loudspeaker, according to claim 23, further comprising a step for grinding an extra portion of said organic material on the surface after said organic material is hardened.

25. A method for manufacturing a piezoelectric loudspeaker, which comprises a compound piezoelectric sheet having a flat shape wherein multiple piezoelectric devices are arranged in an organic material; electrodes, each of which is provided on each face of said compound piezoelectric sheet; an acoustic impedance matching support layer, extended to cover said electrodes, for maintaining said compound piezoelectric sheet in a curved shape and for matching an acoustic impedance; and a support frame for supporting said compound piezoelectric sheet at a circumference, said piezoelectric sheet being manufactured by the steps of:

annealing, before sintering, a comparatively soft ceramic material, having a thin sheet shape, that consists of ceramic powder and an organic binder;

dividing said ceramics material having said thin sheet shape that is annealed by a press machine, of which press faces have predetermined raised and depressed portions, and forming said multiple piezoelectric devices; and introducing said organic material into gaps between said multiple piezoelectric devices, which are slightly separated from each other, and hardening said organic material.

26. A method, for manufacturing a piezoelectric loudspeaker, according to claim 25, further comprising the step of grinding an extra portion of said organic material on the surface after said organic material is hardened.

27. A piezoelectric loudspeaker comprising:

a compound piezoelectric sheet having a flat shape wherein multiple piezoelectric devices are arranged in an organic material, said sheet having a first face and a second face;

electrodes, each of which is provided on each face of said compound piezoelectric sheet;

an acoustic impedance matching support layer located on one of said first or second faces, extended to cover said electrodes, for maintaining said compound piezoelectric sheet in a curved shape and for matching an acoustic impedance;

a protective film for protecting one of said electrodes, said film provided on the other of said first or second faces opposite to that on which said acoustic impedance matching support layer is formed; and a support frame for supporting said compound piezoelectric sheet around a circumference.

* * * * *

UNITED STATES PATENT AND TRADEMARK OFFICE

CERTIFICATE OF CORRECTION

PATENT NO. : 5,684,884

DATED : November 4, 1997

INVENTOR(S) : Chitose Nakaya, et. al.

It is certified that error appears in the above-identified patent and that said Letters Patent is hereby corrected as shown below:

Title page, item [73], Assignee: add "Hitachi, Ltd., Tokyo, Japan" --.

Signed and Sealed this

Tenth Day of March, 1998

*Attest:*

*Attesting Officer*

BRUCE LEHMAN

*Commissioner of Patents and Trademarks*

Disclaimer

5,684,884—Chitose Nakaya; Shigeru Jomura, both of Tokyo; Juro Endo, Kumagaya, all Japan. PIEZOELECTRIC LOUDSPEAKER AND A METHOD FOR MANUFACTURING THE SAME. Patent dated Nov. 4, 1997. Disclaimer filed Jan. 26, 2006, by the Assignee, Hitachi Metals, Ltd.

Hereby enter this disclaimer to all claims, of said patent.

*Official Gazette, March 21, 2006*